US007665830B2

(12) United States Patent
Hashimoto et al.

(10) Patent No.: US 7,665,830 B2
(45) Date of Patent: Feb. 23, 2010

(54) LIQUID DISCHARGE HEAD, LIQUID DISCHARGE DEVICE, AND IMAGE FORMING DEVICE

(75) Inventors: Kenichiroh Hashimoto, Kanagawa (JP); Kiyoshi Yamaguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 334 days.

(21) Appl. No.: 11/666,479

(22) PCT Filed: Nov. 15, 2005

(86) PCT No.: PCT/JP2005/021328

§ 371 (c)(1),
(2), (4) Date: Apr. 26, 2007

(87) PCT Pub. No.: WO2006/057207

PCT Pub. Date: Jun. 1, 2006

(65) Prior Publication Data

US 2007/0257968 A1 Nov. 8, 2007

(30) Foreign Application Priority Data

Nov. 29, 2004 (JP) ..... 2004-344075
Oct. 3, 2005 (JP) ..... 2005-290417

(51) Int. Cl.
*B41J 2/045* (2006.01)

(52) U.S. Cl. ..... 347/68

(58) Field of Classification Search ..... 347/68, 347/70–72

See application file for complete search history.

(56) References Cited

U.S. PATENT DOCUMENTS 5,193,256 A 3/1993 Ochiai et al.
5,365,645 A 11/1994 Walker et al.
5,907,340 A 5/1999 Katakura et al.
6,367,914 B1 4/2002 Ohtaka et al.
6,682,185 B2 1/2004 Hashimoto et al.
6,729,716 B2 5/2004 Eguchi et al.
6,913,348 B2 7/2005 Hashimoto et al.
7,090,325 B2 8/2006 Hashimoto et al.
2005/0231561 A1 10/2005 Hashimoto

FOREIGN PATENT DOCUMENTS

EP 0522814 A2 1/1993
EP 0615845 A2 9/1994
EP 0755791 A2 1/1997

(Continued)

OTHER PUBLICATIONS

Oct. 1, 2008 search report in connection with a counterpart European patent application No. 05 80 4024.

*Primary Examiner*—An H Do
(74) *Attorney, Agent, or Firm*—Cooper & Dunham, LLP

(57) ABSTRACT

A liquid discharge head comprises a base member, a plurality of nozzles which discharge drops of a liquid, a plurality of liquid chambers which communicate with the plurality of nozzles respectively, and a plurality of piezoelectric elements generating a pressure to pressurize the liquid in each of the plurality of liquid chambers. In the liquid discharge head, a plurality of piezoelectric element members in which the plurality of piezoelectric elements are formed with grooves in columns by slot processing are arranged on the base member in rows along a direction of the columns of the plurality of piezoelectric elements.

14 Claims, 18 Drawing Sheets

FOREIGN PATENT DOCUMENTS

| | | |
|---|---|---|
| EP | 0921003 A1 | 6/1999 |
| JP | 6-198877 | 7/1994 |
| JP | 3114771 | 9/2000 |
| JP | 2001-219561 | 8/2001 |
| JP | 2003-250281 | 9/2003 |

LIQUID DISCHARGE HEAD, LIQUID DISCHARGE DEVICE, AND IMAGE FORMING DEVICE

TECHNICAL FIELD

The present invention relates to a liquid discharge head, a liquid discharge device, and an image forming device.

BACKGROUND ART

Conventionally, in various image forming devices, such as printers, facsimiles, copiers, plotters, and multi-function peripherals, a liquid discharge head which discharges a liquid to a recording medium is installed to form an image on the recording medium.

In the following, the liquid discharge device means a device which discharges drops of a liquid to a recording medium. The recording medium may be paper, yarn, fiber, textile, leather, metal, plastic, glass, wood, ceramics, etc. The recording medium is also called a printing medium, a copy sheet, etc., and these are used as the synonym irrespective of the kind of the material. The term "recording" means not only creating a meaningful image, such as characters and figures, on the recording medium, but also creating a meaningless image, such as a pattern, on the recording medium. Recording is also called image formation or printing, and these are also used as the synonym.

An ink jet head is an example of the liquid discharge head, and specifically a piezoelectric type ink jet head is well known. In the piezoelectric type ink jet head, a piezoelectric element is used as a pressure generating unit for generating a pressure which pressurizes an ink (or the liquid) in the liquid chamber. Especially, a laminated type piezoelectric element in which a piezoelectric layer and an internal electrode are laminated is used. With the laminated type piezoelectric element being driven, a resilient diaphragm which forms the surface of a wall of the liquid chamber is elastically deformed by a displacement in the d33 or d31 direction of the piezoelectric element, and changes the internal capacity/pressure of the liquid chamber so that an ink drop is discharged from the nozzle of the ink jet head.

For example, Japanese Patent No. 3114771 discloses an ink jet head using such a laminated type piezoelectric element. In the ink jet head of this document, the piezoelectric layers and the internal electrodes are alternately laminated to form the laminated type piezoelectric element (driver element block). At end portions of the laminated type piezoelectric element, the individual external electrodes and the common external electrodes are formed. Slot processing of the laminated type piezoelectric element is performed by leaving a part thereof, so that a plurality of actuation parts (drive channels) in the center thereof and non-actuation parts at both ends thereof are formed. In operation, the laminated type piezoelectric element generates the pressure which pressurizes the liquid in the liquid chamber by a displacement in the d31 direction of the laminated type piezoelectric element. The common electrodes of this laminated type piezoelectric element are taken from the non-actuation parts at the both ends in the row direction of the actuation parts.

Moreover, Japanese Laid-Open Patent Application No. 2003-250281 discloses an ink jet head which uses the displacement in the d33 direction of a laminated type piezoelectric element. In the ink jet head of this document, slot processing of the piezoelectric element bonded to the base surface is performed, and the individual piezoelectric elements corresponding to the liquid chambers with which the nozzles communicate are formed.

Moreover, Japanese Laid-Open Patent Application No. 06-198877 discloses a line type ink jet head. In the line type ink jet head of this document, a plurality of nozzle openings are arranged on a single continuous nozzle plate to form the nozzle plate. The piezoelectric elements are disposed to face the corresponding nozzle openings by processing of a plurality of bulk piezoelectric crystals, and the boundary portion of the adjoining bulk piezoelectric crystals is the processing region.

In recent years, the ink-jet recording device as an image forming device is demanded for high-speed printing. The methods for achieving high-speed printing of the ink-jet recording device may include a method of increasing the ink discharge frequency, and a method of increasing the number of nozzles. However, if the ink discharge frequency is increased, it is necessary to move the head carriage in the ink-jet recording device at high speed corresponding to the increased ink discharge frequency. It is difficult to control the powerful motor with sufficient accuracy and perform the ink discharging at high frequency with good stability.

To eliminate the problems, the use of an elongated head, such as a line, in which the length of the head is lengthened and the number of nozzles is increased, is taken into consideration. However, in order to lengthen the length of the head with the head configuration as in Japanese Patent No. 3114771 or Japanese Laid-Open Patent Application No. 2003-250281 used, it is necessary to lengthen the length of each of the component parts of the head. Since the piezoelectric element, such as PZT, is a very slender long part, enlarging the length of the head will cause the difficulty in respect of the manufacturing process or handling of the piezoelectric element.

Moreover, in the case of the line type ink jet head of Japanese Laid-Open Patent Application No. 06-198877, the plurality of bulk piezoelectric crystals must be divided into the piezoelectric elements. Since slanting or chipping of the piezoelectric elements is likely to arise, the yield worsens and the manufacturing cost becomes high.

SUMMARY

In an aspect of this disclosure, there is provided a liquid discharge head which can be constructed in an elongated configuration with low cost, as well as a liquid discharge device and an image forming device in which the liquid discharge head is provided.

In another aspect of this disclosure, there is provided a liquid discharge head comprising: a base member; a plurality of nozzles which discharge drops of a liquid; a plurality of liquid chambers which communicate with the plurality of nozzles respectively; and a plurality of piezoelectric elements generating a pressure to pressurize the liquid in each of the plurality of liquid chambers, wherein a plurality of piezoelectric element members in which the plurality of piezoelectric elements are formed with grooves in columns by slot processing are arranged on the base member in rows along a direction of the columns of the plurality of piezoelectric elements.

In another aspect of this disclosure, there is provided a liquid discharge device which includes a liquid discharge head and a liquid container, the liquid discharge head comprising: a base member; a plurality of nozzles which discharge drops of a liquid; a plurality of liquid chambers which communicate with the plurality of nozzles respectively; and a plurality of piezoelectric elements generating a pressure to pressurize the liquid in each of the plurality of liquid chambers, wherein a plurality of piezoelectric element members in which the plurality of piezoelectric elements are formed with grooves in columns by slot processing are arranged on the base member in rows along a direction of the columns of the plurality of piezoelectric elements.

In another aspect of this disclosure, there is provided an image forming device which is provided with a liquid discharge head and forms an image on a recording medium by discharging drops of a liquid from the liquid discharge head to the recording medium, liquid discharge head comprising: a base member; a plurality of nozzles which discharge drops of a liquid; a plurality of liquid chambers which communicate with the plurality of nozzles respectively; and a plurality of piezoelectric elements generating a pressure to pressurize the liquid in each of the plurality of liquid chambers, wherein a plurality of piezoelectric element members in which the plurality of piezoelectric elements are formed with grooves in columns by slot processing are arranged on the base member in rows along a direction of the columns of the plurality of piezoelectric elements.

The above-mentioned liquid discharge head may be configured so that a groove at a boundary portion between two adjacent columns of the plurality of piezoelectric element members is further formed by the slot processing.

The above-mentioned liquid discharge head may be configured so that a gap is formed in a boundary portion between two adjacent columns of the plurality of piezoelectric element members and the gap has a width smaller than a width of one of the grooves formed by the slot processing.

The above-mentioned liquid discharge head may be configured so that common external electrodes are electrically connected to the base member to supply a drive waveform to each of the plurality of piezoelectric elements.

The above-mentioned liquid discharge head may be configured so that the plurality of piezoelectric elements and the base member are bonded together by using a conductive adhesive agent.

The above-mentioned liquid discharge head may be configured so that a nozzle plate in which the plurality of nozzles are formed is provided for the plurality of piezoelectric element members.

The above-mentioned liquid discharge head may be configured so that the plurality of piezoelectric element members are arranged in columns on the base member, a gap is formed in a boundary portion between an m-th piezoelectric element column (where m is an integer greater than one) and an (m+1)-th piezoelectric element member of the plurality of piezoelectric element members, and the gap has a width smaller than a width of one or the grooves by the slot processing.

The above-mentioned liquid discharge head may be configured so that a plurality of convex parts are respectively disposed at a plurality of bonded portions between the plurality of piezoelectric elements and a diaphragm which forms a surface of walls of the plurality of liquid chambers.

In the liquid discharge head, the plurality of piezoelectric element members in which the plurality of piezoelectric elements are formed by slot processing are arranged along the row direction of the plurality of piezoelectric elements on the single base member, and slanting or chipping of the individual piezoelectric elements can be prevented, and the manufacture of an elongated ink jet head with low cost can be attained.

Each of the liquid discharge device and the image forming device can be provided with the above-mentioned liquid discharge head, and it is possible to achieve the high-speed printing.

Other aspects, features and advantages will be apparent from the following detailed description when reading in conjunction with the accompanying drawings.

BEST MODE FOR CARRYING OUT THE INVENTION

A description will now be given of an embodiment of the invention with reference to the accompanying drawings.

Figure 1:
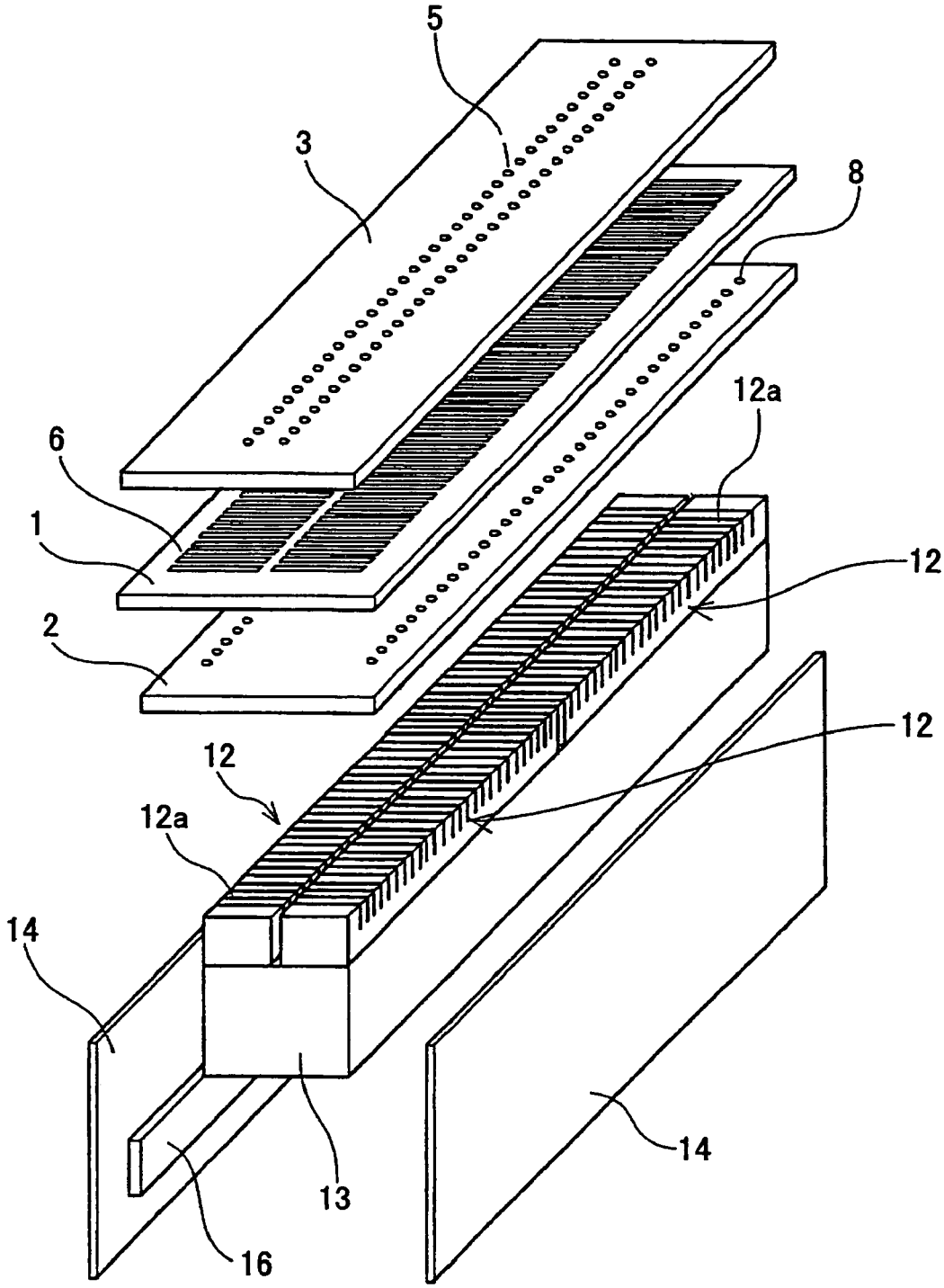
FIG. 1 is an exploded perspective view of the liquid discharge head in the 1st embodiment of the invention.

The composition of an ink jet head which is the liquid discharge head in the 1st embodiment of the invention will be explained with reference to FIG. 1 and FIG. 2. FIG. 1 is an exploded perspective view of the ink jet head, and FIG. 2 is a cross-sectional view of the ink jet head taken along the longitudinal direction of the liquid chamber in the ink jet head of FIG. 1.

Figure 2:
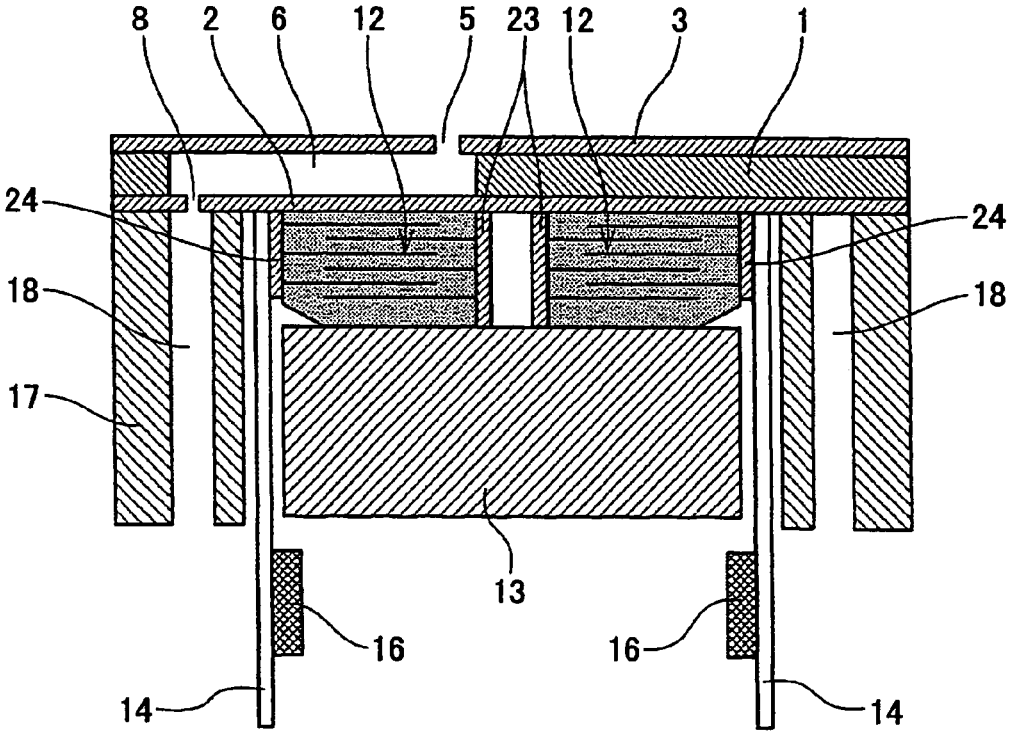
FIG. 2 is a cross-sectional view of the liquid discharge head taken along the longitudinal direction of the liquid chamber of the liquid discharge head of FIG. 1.

As shown in FIG. 1 and FIG. 2, the ink jet head of this embodiment comprises a channel plate (liquid chamber plate) 1 which is made of a SUS (stainless steel) plate, a diaphragm 2 bonded to the undersurface of the channel plate 1, and a nozzle plate 3 bonded to the upper surface of the channel plate 1. By means of these plates 1 to 3, a plurality of nozzles 5, a plurality of pressurized liquid chambers 6, and a plurality of flow-resistance parts 8 are formed. Each nozzle 5 serves to discharge an ink drop (which is a drop of the recording liquid) and communicates with a corresponding one of the pressurized liquid chambers 6. Each flow-resistance part 8 serves as a liquid supply route to supply the ink (which is the liquid) to a corresponding one of the pressurized liquid chambers 6.

The channel plate 1 is prepared by machining (or punching) of the SUS plate or etching of the SUS plate using an acid etching reagent, so that the respective pressurized liquid chambers 6, the respective flow-resistance parts 8, and the openings are formed.

The diaphragm 2 in this embodiment is made of a metal plate, such as a nickel plate. Alternatively, the diaphragm 2 may be made of a resin plate, or a laminated member of a resin plate and a metal plate, etc.

The nozzle plate 3 is formed with the plurality of nozzles 5 corresponding to the plurality of pressurized liquid chambers 6, and each nozzle 5 has a diameter in a range of 10-30 micrometers. The nozzle plate 3 is bonded to the channel plate 1 by using an adhesive. The source materials of this nozzle plate 3 may include a metal, such as stainless steel and nickel, a resin, such as a polyimide resin film, silicon, and any combination of these materials.

In order to secure water repellence with ink, a water-repellent film is formed on the nozzle surface (the upper surface in the discharge direction, or the discharge surface) by using a known method, such as plating film or water repellent coating.

And a plurality of laminated type piezoelectric elements 12*a* which correspond to the plurality of pressurized liquid chambers 6 and serve as a pressure generating unit are bonded to the outside surface of the diaphragm 2 (which surface is opposite to the pressurized liquid chamber 6 surface). The diaphragm 2 and the laminated type piezoelectric element 12*a* constitute a piezoelectric actuator which elastically deforms the diaphragm 2 which is a movable part.

In the case of the ink jet head mentioned above, a plurality of piezoelectric element members 12 which are not subjected to slot processing to form the divided piezoelectric elements 12*a* (also called individual piezoelectric elements 12*a*) are arranged in parallel with the directions of rows of the piezoelectric elements 12*a* (the longitudinal direction of the piezoelectric element members 12). In this case, the surfaces of the piezoelectric element members 12 which are opposite to the diaphragm 2 surface are bonded to a base member (base) 13 by an adhesive, and thereafter a plurality of grooves 30 are formed by performing slot processing, so that the plurality of piezoelectric elements 12*a* are formed. In addition, the FPC (flexible printed cable) 14 for supplying a drive waveform to the respective piezoelectric elements 12*a* is connected to the end surface of the piezoelectric element member 12.

The composition of the piezoelectricity of the piezoelectric elements 12*a* which pressurizes the ink in the pressurized liquid chamber 6 may be configured by using a displacement in the d33 direction. Alternatively, it may be configured by using a displacement in the d31 direction. In this embodiment, the composition in which the displacement in the d33 direction is used is configured.

It is preferred that the base member 13 is made of a metallic material. If the material (source material) of the base member 13 is a metal, the thermal accumulation by the self-heating of the piezoelectric elements 12*a* (or the piezoelectric element member 12) can be prevented. The base member 13 is bonded to the piezoelectric element member 12 by using the adhesive agent. When the number of channels is increased, the temperature of the base member 13 will rise to about 100 degrees C. by the self-heating of the piezoelectric elements 12*a*, and the bonding strength may fall remarkably. Also the head inside temperature rise occurs by the self-heating, the ink temperature will rise. If the ink temperature rises, the ink viscosity falls, which will affect the ink discharge characteristics. Therefore, by forming the base member 13 of a metallic material, it is possible to prevent the thermal accumulation by the self-heating of the piezoelectric elements 12*a*, and it is possible to prevent the degradation of the ink discharge characteristics due to the fall of the adhesion strength and the fall of the ink viscosity.

When the coefficient of linear expansion of the base member 13 is large, separation of the adhesive agent may occur at a high temperature or low temperature in the area of the bonding interface between the base member 13 and the piezoelectric element member 12. In the case of a conventional ink jet head, the full length of the piezoelectric element is not so large, and there has been almost no problem that a separation in the area of the bonding interface between the base member 13 and the piezoelectric element member 12 occurs by a temperature change of the environmental conditions. However, in the case of the elongated piezoelectric element 30-40 mm or longer used in the ink jet head having about 400 nozzle for 300 dpi resolution, the problem may actually occur.

Therefore, it is preferred to use the source material of the base member 13 whose coefficient of linear expansion is smaller than $10E^{-6}$/degree C. If the coefficient of linear expansion falls within the above range, it is possible to prevent the separation of the bonding interface between the base member 13 and the piezoelectric element member 12. It is confirmed that the use of the source material of the base member 13 whose coefficient of linear expansion is smaller than $10E^{-6}$/degree C. is very effective in preventing the separation of the bonding interface.

A plurality of driver ICs 16 for applying the drive waveform (electrical signal) which drives the respective channels (which correspond to the pressurized liquid chambers 6 respectively) are carried on the FPC cable 14. The plurality of driver ICs 16 are carried on the FPC cable 14, and an electrical signal can be set up for each driver IC 16, and it is possible to easily correct dispersion in the displacement characteristics of each of the drive channels of the piezoelectric elements 12*a*.

The frame member 17 is bonded to the circumference of the diaphragm 2 by the adhesive agent. And in the frame member 17, the common liquid chamber 18 for supplying the ink from the exterior to the pressurized liquid chamber 6 is formed, so that it is arranged on both sides of the base member 13 and the driver ICs 16. The common liquid chamber 18 communicates with the pressurized liquid chambers 6 via the flow-resistance parts 8 of the diaphragm 2.

Next, the details of the laminated type piezoelectric element member 12 will be explained with reference to FIG. 3 through FIG. 6B.

Figure 3:
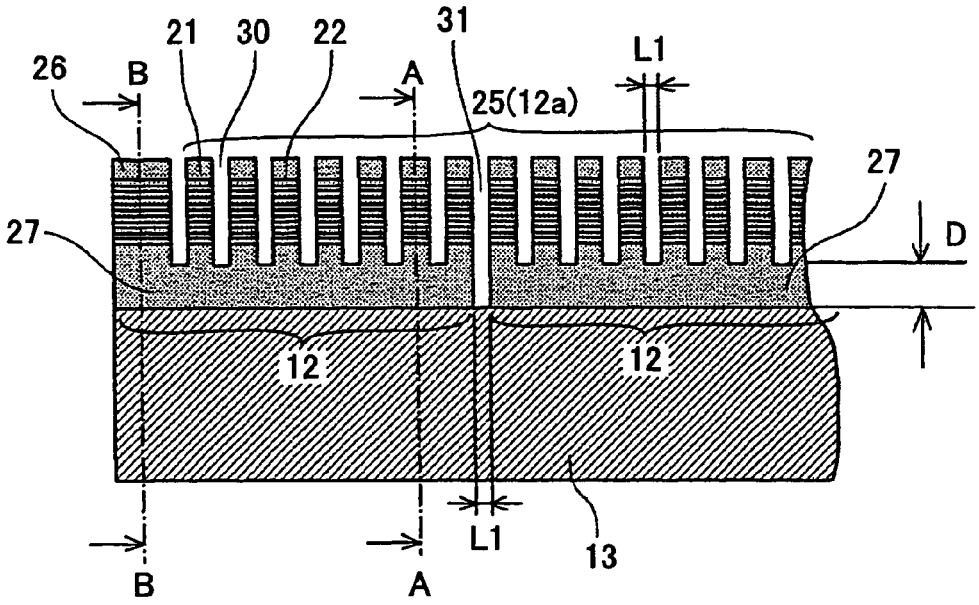
FIG. 3 is an enlarged diagram of the portion of the laminated type piezoelectric element member of the liquid discharge head of FIG. 1.
Figure 4:
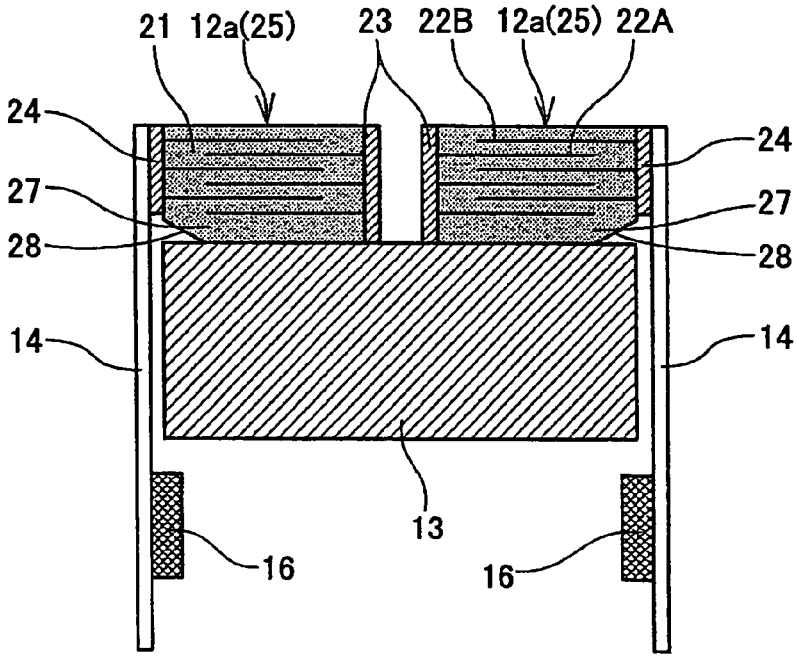
FIG. 4 is a cross-sectional view of the portion of the laminated type piezoelectric element member taken along the line A-A indicated in FIG. 3.
Figure 5:
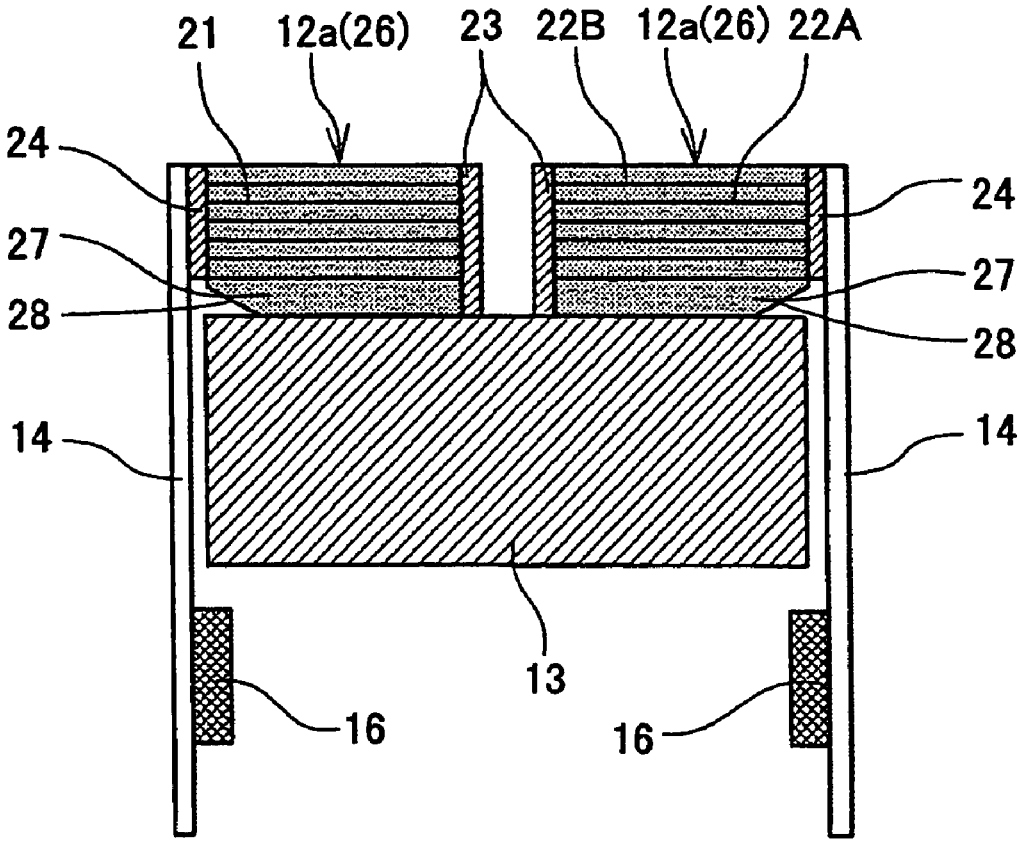
FIG. 5 is a cross-sectional view of the portion of the laminated type piezoelectric element member taken along the line B-B indicated in FIG. 3.
Figure 6A:
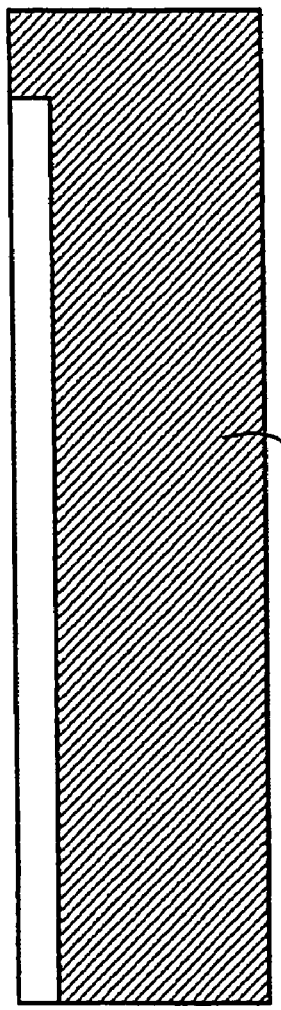
FIG. 6A and FIG. 6B are plan views of the internal electrode patterns of the laminated type piezoelectric element member of FIG. 3.
Figure 6B:
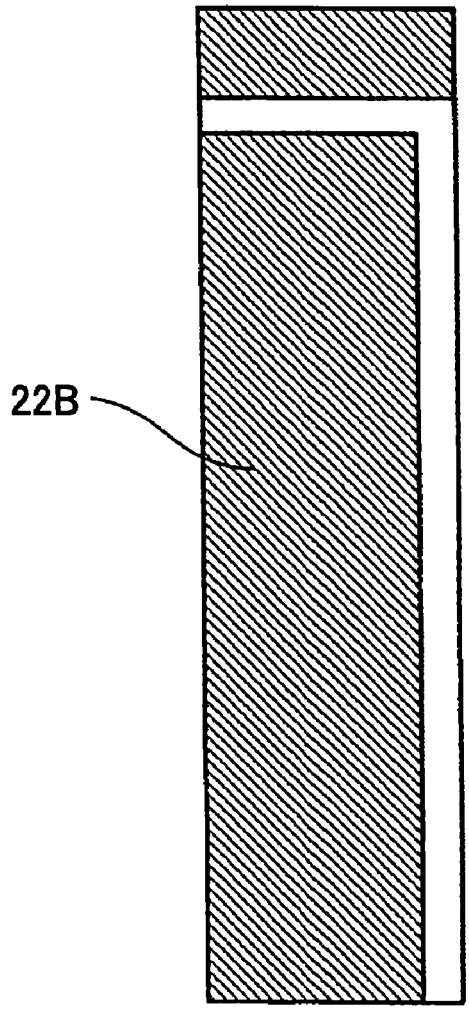

FIG. 3 is an enlarged diagram of the portion of the laminated type piezoelectric element member of the liquid discharge head of FIG. 1 in the lateral direction of the liquid chamber. FIG. 4 is a cross-sectional view of the portion of the laminated type piezoelectric element member taken along the line A-A indicated in FIG. 3. FIG. 5 is a cross-sectional view of the portion of the laminated type piezoelectric element member taken along the line B-B indicated in FIG. 3. FIG. 6A and FIG. 6B are plan views of the internal electrode patterns of the laminated type piezoelectric element member of FIG. 3.

As shown in FIG. 4, in each of the laminated type piezoelectric element members 12, the piezoelectric material layer 21, the internal electrodes 22A in the pattern of FIG. 6A, and the internal electrodes 22B in the pattern of FIG. 6B are alternately laminated. The common external electrodes 23 are electrically connected to the base member 13 to supply the drive waveform to each of the piezoelectric elements 12*a*. By performing slot processing of the laminated type piezoelectric element member 12 in the state where the common external electrodes 23 and the individual external electrodes 24 are formed on the end surfaces of the laminated type piezoelectric element member 12, so that the plurality of grooves 30 and the plurality of piezoelectric elements 12*a* are formed. In this case, the piezoelectric elements 12*a* to which the drive waveform is supplied constitute the actuation parts 25, and the piezoelectric elements 12*a* at the end portions constitute the non-actuation parts 26.

The two laminated type piezoelectric element members 12 are arranged such that a gap 31 is formed at the boundary portion therebetween. This gap 31 has a width L1 which is the same as the width L1 of the grooves 30 (for example, the width of 0.03 mm formed by dicing). Thus, the plurality of individual piezoelectric elements 12*a* can be continuously formed without boundary portion in the lateral direction of the liquid chamber by locating the gap 31, having the same width as the width of the grooves 30, at the boundary portion between the two laminated type piezoelectric element members 12.

Moreover, when the slot processing is performed, the grooves 30 are formed in the laminated type piezoelectric element members 12 so as not to reach the base member 13, and the bridging part 27 having a height D in the depth direction is formed as shown in FIG. 3. Thereby, each of the two laminated type piezoelectric element members 12 has the plurality of piezoelectric elements 12*a* integrally formed therewith. In addition, the notch parts 28 along the direction of the row of the actuation parts 25 are formed in the bottom of the laminated type piezoelectric element members 12 on the sides of the individual external electrodes 24.

In the present embodiment, the internal electrodes 22A of each actuation part 25 are connected to the common external electrodes 23, and the common external electrodes 23 are not separated by the bridging part 27. Therefore, the internal electrodes 22A of each actuation part 25 are connected to the internal electrodes 22A of the non-actuation parts 26 at the both ends via the common external electrodes 23. Moreover, the internal electrodes 22A of the non-actuation parts 26 are taken out to the side edge surfaces of the individual external electrodes 24 as shown in FIG. 3 and FIG. 5. The common electrode and the individual electrodes can be taken out from one of the end surfaces of the laminated type piezoelectric element member 12 by connecting the FPC cable 14 to the end surface on the side of the individual external electrodes 24.

In the ink jet head which is configured as in the above-described embodiment, the driving pulse voltage in a range of 20-50V is selectively applied to the actuation parts 25 (the piezoelectric elements 12*a*) of the laminated type piezoelectric element members 12. And the actuation parts 25 to which the driving pulse voltage is applied are expanded in the lamination direction, the diaphragm 2 is elastically deformed in the nozzle 5 direction, and the ink in the pressurized liquid chamber 6 is pressurized by the capacity/volume change of the pressurized liquid chamber 6, so that the ink jet is discharged from the nozzle 5.

After the discharging of the ink drop, the liquid pressure in the pressurized liquid chamber 6 declines, and a certain negative pressure is generated in the pressurized liquid chamber 6 due to the inertia of the ink flow at this time. By turning the driving voltage applied to the laminated type piezoelectric element 12 in OFF state under this state, the diaphragm 2 is returned to the original position and the shape of the pressurized liquid chamber 6 is returned to the original shape, so that a further negative pressure is generated in the pressurized liquid chamber 6. At this time, the ink from the common liquid chamber 18 is supplied to the pressurized liquid chamber 6 via the flow-resistance part 8. Then, after the vibration of the ink-meniscus surface of the nozzle 5 is declined and stabilized, the driving pulse voltage is applied to the laminated type piezoelectric element 12 for subsequent discharging of the ink drop, so that the ink drop is discharged subsequently.

In the above embodiment, the push-strike method is applied for discharging the ink drop. Alternatively, the pull-strike method or the pull-push-strike method may be applied instead. And any of these methods can be set up in accordance with the driving pulse waveform supplied to the ink jet head.

In the above-described ink jet head, the two laminated type piezoelectric element members 12 are arranged side by side on the single base member 13, and the plurality of piezoelectric elements 12*a* (the actuation parts 25) are formed by performing the slot processing in the longitudinal direction of the base member 13 (the direction of the row of the piezoelectric elements 12*a*). Accordingly, the liquid discharge head of this embodiment can be constructed in an elongated configuration with low cost, and the number of nozzles included in the liquid discharge head can be increased by the elongated configuration.

As previously described, to achieve high-speed printing of a liquid discharge head, the method of increasing the number of nozzles included in the head by using an elongated configuration of the head is effective. However, the laminated type piezoelectric element becomes a slender, long part, and this will cause the difficulty in respect of the manufacturing process or handling of the piezoelectric element.

According to the above-described ink jet head, the above-mentioned problem is eliminated as follows. The laminated type piezoelectric element member is divided into two pieces, and the two laminated type piezoelectric element members are arranged on the single base member and they are bonded to the base member by using the adhesive agent. Thus, the elongated configuration of the liquid discharge head can be achieved in this manner.

In this case, after the two laminated type piezoelectric element members are arranged on the base member 13, the slot processing is performed through the machining, such as dicing, and the plurality of piezoelectric elements 12*a* are formed. After the heat treatment of the laminated type piezoelectric element members 12 is performed, the machining, such as dicing, is performed so that the outside dimension thereof can be obtained with sufficient accuracy.

By using the base member 13 of the metallic material with good rigidity and arranging the two laminated type piezoelectric element members 12 on the base member 13, the positional deviation of the piezoelectric elements can be reduced. And the slot processing is performed through dicing or the like after the laminated type piezoelectric element members 12 are arranged on the base member 13. There is no need for handling the laminated type piezoelectric elements after the slot processing is performed which will easily be broken. The position of the grooves between the two laminated type piezoelectric element members 12 can be controlled by the feed accuracy of the dicing blade.

In order to fit the height of respective piezoelectric elements 12*a* of the two laminated type piezoelectric element members 12, grinding of the top surface of the two laminated type piezoelectric element members 12 may be performed after the two laminated type piezoelectric element members 12 are bonded to the base member 13.

When the two or more laminated type piezoelectric element members 12 are arranged as mentioned above, it is preferred that the nozzle plate 3 is a single plate component provided for the two or more laminated type piezoelectric element members 12. If the nozzle plate 3 is divided into plural components, during the wiping operation of the nozzles, a poor wiping of the ink may arise due to the grooves and the level difference at the boundary portion of the nozzle plate components, and degradation of the image quality may take place.

Figure 7:
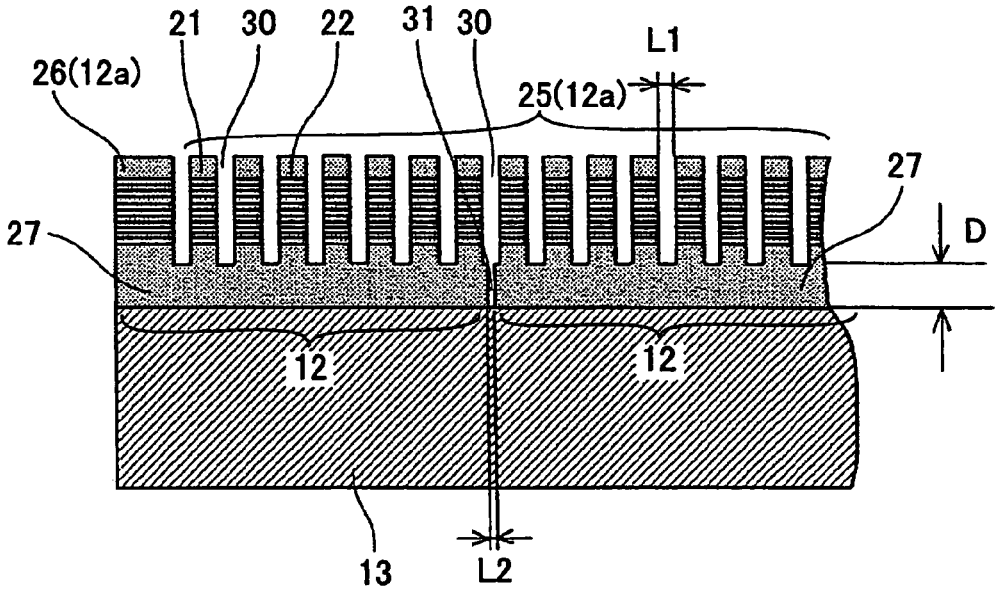
FIG. 7 is an enlarged diagram of the laminated type piezoelectric element member portion of the liquid discharge head in the 2nd embodiment of the invention.

Next, the composition of an ink jet head which is the liquid discharge head in the 2nd embodiment of the invention will be explained with reference to FIG. 7. FIG. 7 is an enlarged diagram of the portion of the laminated type piezoelectric element members in the liquid discharge head in the 2nd embodiment of the invention.

In the present embodiment, a gap 31 is formed in the boundary portion between the two laminated type piezoelectric element members 12 arranged on the base member 13, and the gap 31 has a width L2 smaller than a width L1 of one of the grooves 30 formed by the slot processing (L2<L1). Therefore, the slot processing is also performed to the boundary portion so that the groove 30 which is the same as each of the grooves 30 is formed at the boundary portion.

In the present embodiment, the laminated type piezoelectric element members 12 have the longitudinal-direction length 55.0125 mm (the tolerance: ±0.005 mm). The gap 31 between the two laminated type piezoelectric element members 12 is equal to 0.01 mm (the tolerance: ±0.003 mm). The dicing width (the width of the groove 30) is equal to 0.03 mm (the tolerance: ±0.002 mm), and the dicing pitch (the pitch of the grooves 30) is equal to 0.08465 mm (the tolerance: ±0.005 mm). The laminated type piezoelectric element members 12 can be produced with the accuracy falling within the tolerance so that the groove 30 is fitted to the gap 31 at the boundary portion between the laminated type piezoelectric element members 12.

In the present embodiment, the laminated type piezoelectric element members 12 are arranged so that the groove 30 may be located at the boundary portion between the laminated type piezoelectric element members 12, and the gap 31 in the boundary portion has a width smaller than the width of the groove 30. Thus, each tolerance can be absorbed and the laminated type piezoelectric element members 12 can be produced with sufficient accuracy.

In the previous embodiment of FIG. 3, the adhesive agent used when bonding the laminated type piezoelectric element members 12 to the base member 13 may enter the gap 31 in the boundary portion between the laminated type piezoelectric element members 12. On the other hand, in the present embodiment of FIG. 7, even if the adhesive agent enters the gap 31 in the boundary portion, the grooves 30 are formed by the slot processing after the bonding is completed. It is possible to avoid the problem that the adhesive agent is inserted between the individual piezoelectric elements 12*a*.

Figure 8:
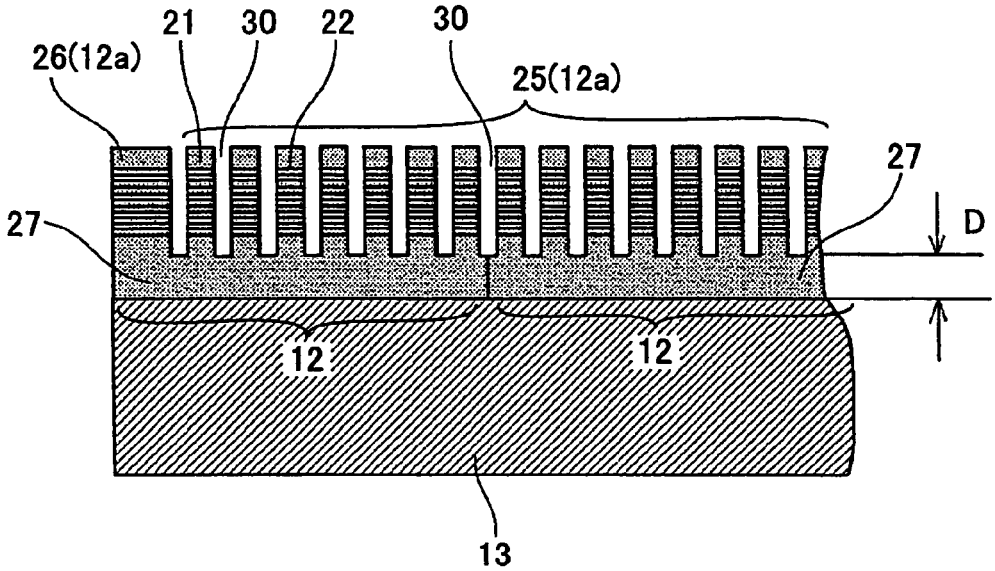
FIG. 8 is an enlarged diagram of the laminated type piezoelectric element member portion of the liquid discharge head in the 3rd embodiment of the invention.

Next, the composition of an ink jet head which is the liquid discharge head in the 3rd embodiment of the invention will be explained with reference to FIG. 8. FIG. 8 is an enlarged diagram of the portion of the laminated type piezoelectric element members in the liquid discharge head in the 3rd embodiment of the invention.

In the present embodiment, the gap in the boundary portion between the laminated type piezoelectric element members 12 is omitted and the laminated type piezoelectric element members 12 are arranged on the base member 13. In this embodiment, the slot processing is also performed to the boundary portion so that the groove 30 which is the same as each of the grooves 30 is formed at the boundary portion. Even if the liquid discharge head in the present embodiment is used, the same effects as in the above-mentioned 2nd embodiment can be obtained.

Figure 9:
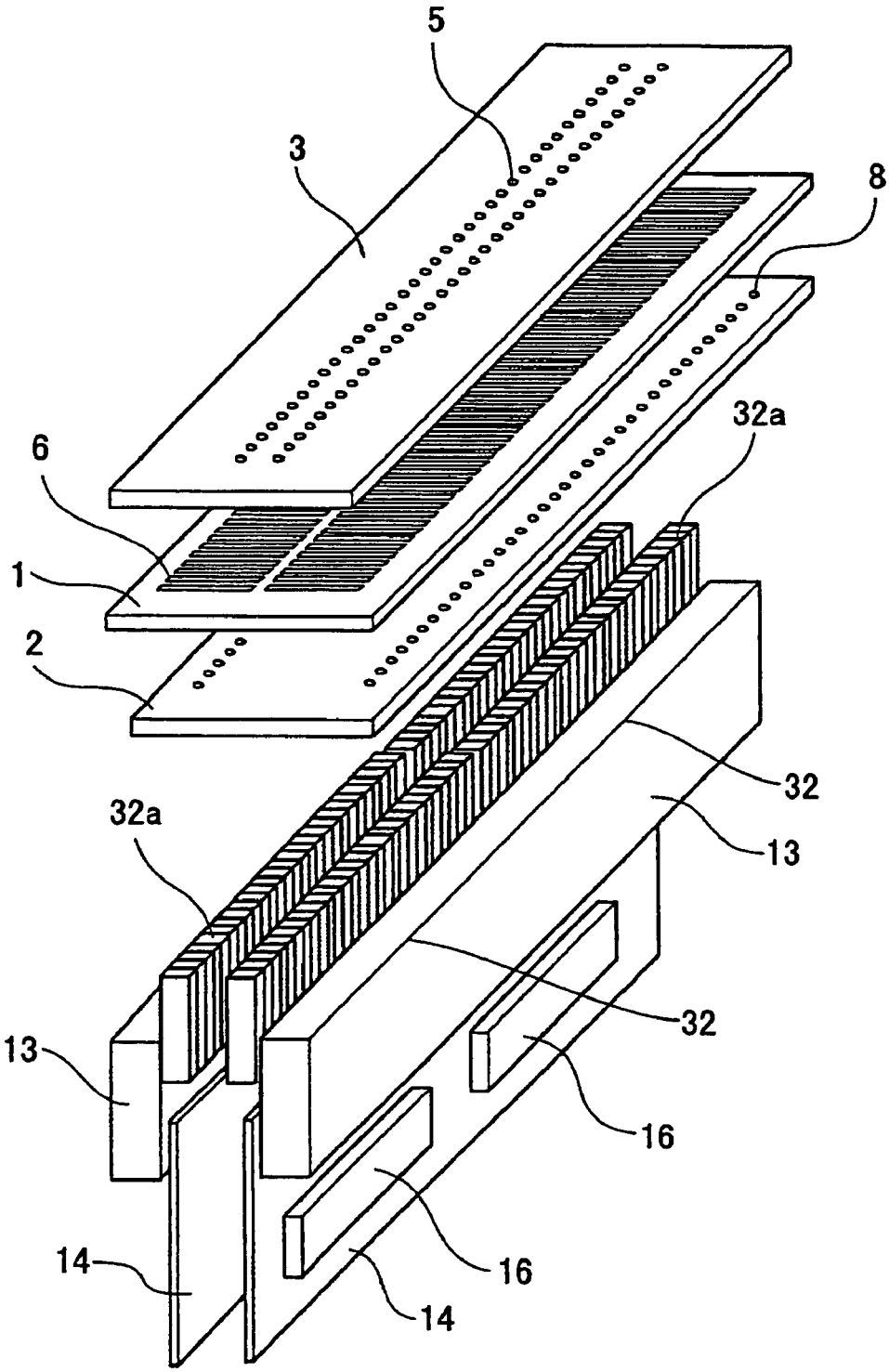
FIG. 9 is an exploded perspective view of the liquid discharge head in the 4th embodiment of the invention.

Next, the composition of an ink jet head which is the liquid discharge head in the 4th embodiment of the invention will be explained with reference to FIG. 9 and FIG. 10. FIG. 9 is an exploded perspective view of the liquid discharge head of this embodiment, and FIG. 10 is a cross-sectional view of the liquid discharge head taken along the longitudinal direction of the liquid chamber of the liquid discharge head of FIG. 9.

In each of the previous embodiments, the liquid discharge head which uses a displacement in the d33 direction of a laminated type piezoelectric element has been described. In contrast, the present embodiment is an example of the liquid discharge-head using a displacement in the d31 direction of a laminated type piezoelectric element.

Figure 10:
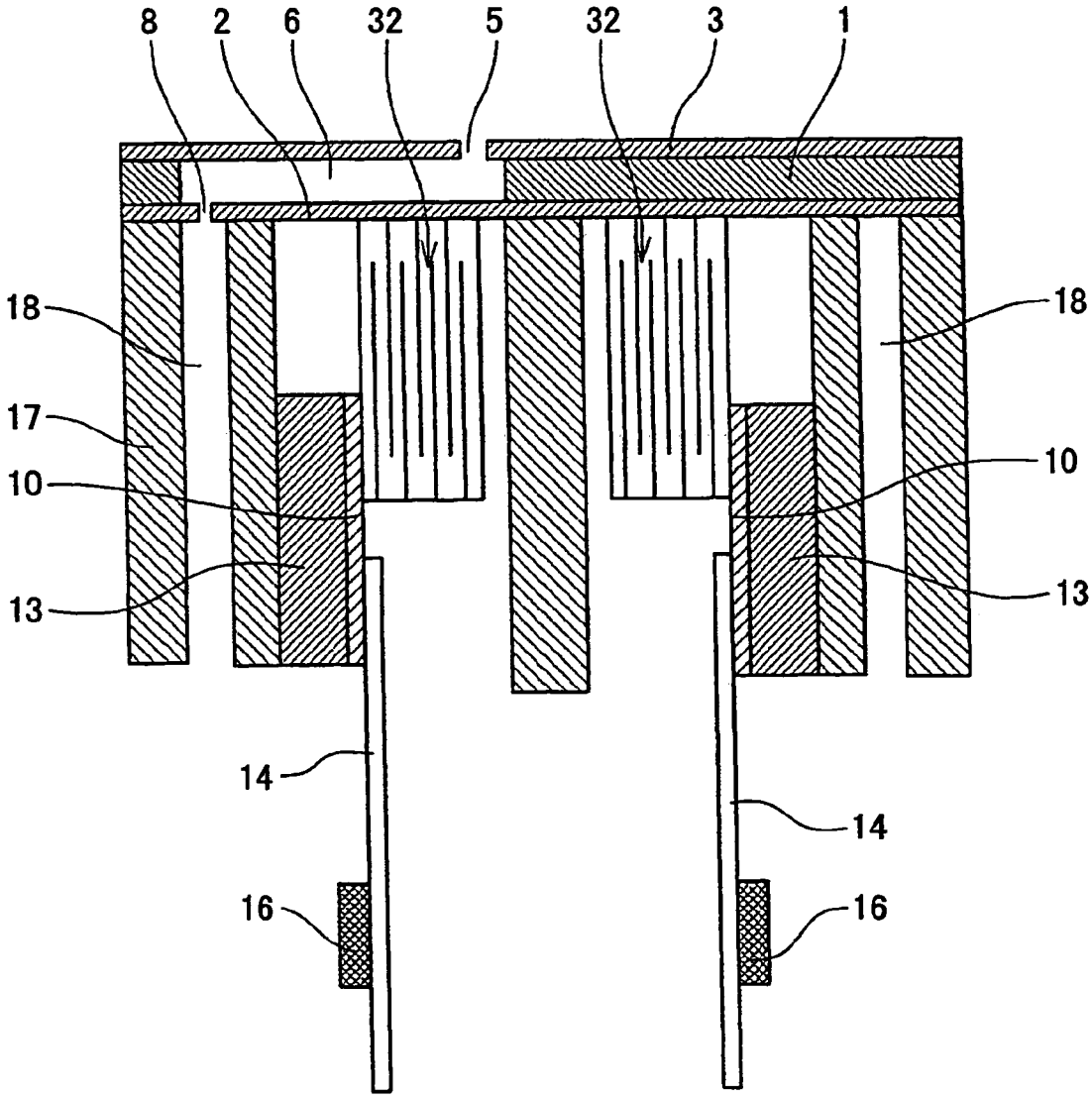
FIG. 10 is a cross-sectional view of the liquid discharge head taken along the longitudinal direction of the liquid chamber of the liquid discharge head of FIG. 9.

In the embodiment of FIG. 9 and FIG. 10, the base members 13 are made of an insulating material, such as ceramics. The thin-film electrode 10 is formed on one surface of each base member 13, and the laminated type piezoelectric element member 32 is bonded to the surface of the thin film electrode 10 of each of the base members 13 by the adhesive agent or soldering. In such circumstances, positioning is carried out using the jig, so that the edges of the base members 13 and the laminated type piezoelectric element members 32 are in parallel with each other. The thin-film electrodes 10 on the laminated type piezoelectric element members 32 and the base members 13 are simultaneously cut using a dicing blade or a wire saw. The individual piezoelectric elements 32*a* arranged at equal pitches are formed.

The thin-film electrodes 10 are also divided, and the pull-out electrodes for the respective piezoelectric elements 32*a* are formed. The FPC cables 14 are bonded to the pull-out electrodes by soldering, etc. The other composition located above the diaphragm 2 in the present embodiment is essentially the same as that of the previous embodiments, and a description thereof will be omitted.

Figure 11:
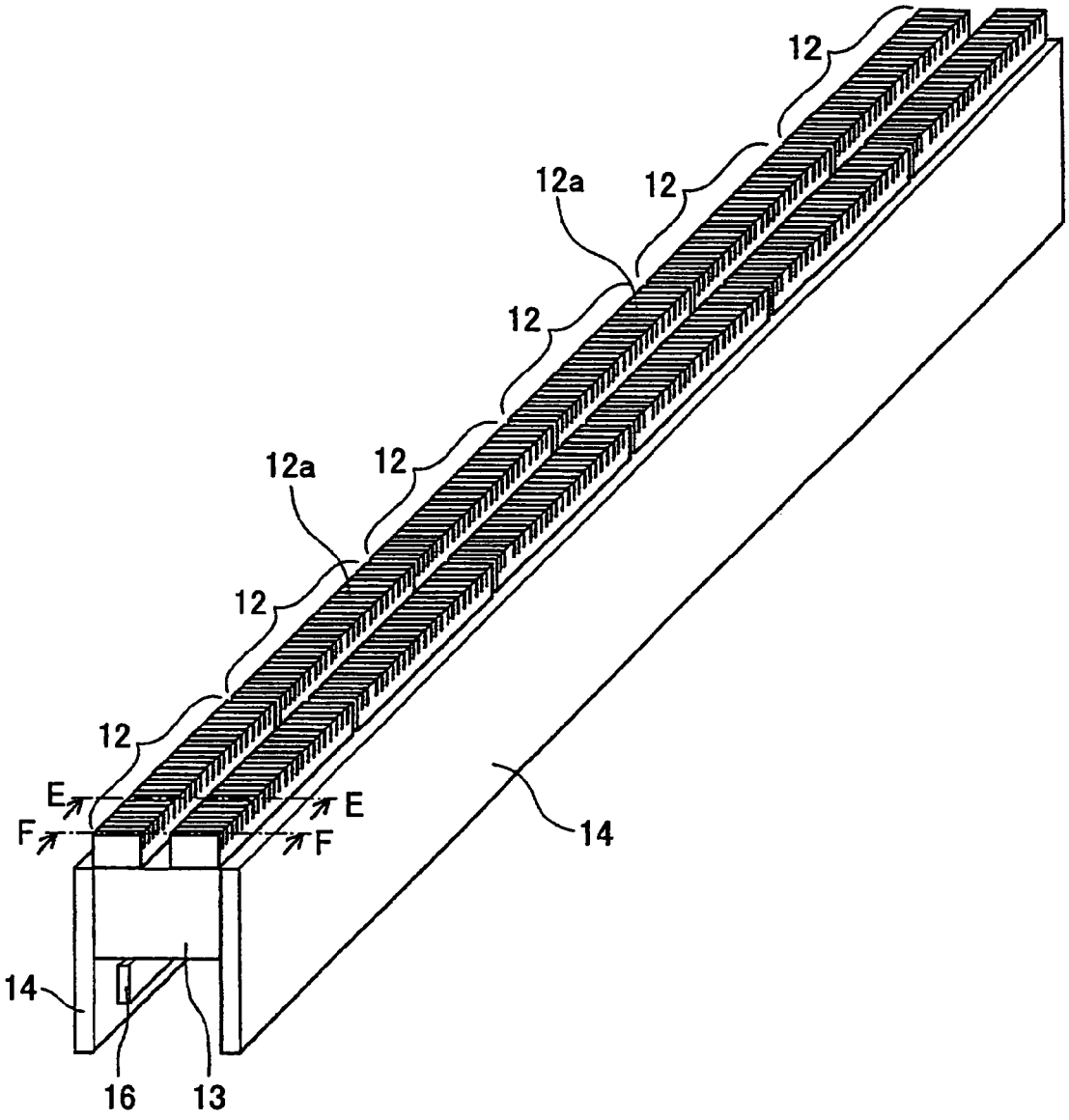
FIG. 11 is a perspective view of the liquid discharge head in the 5th embodiment of the invention.
Figure 12:
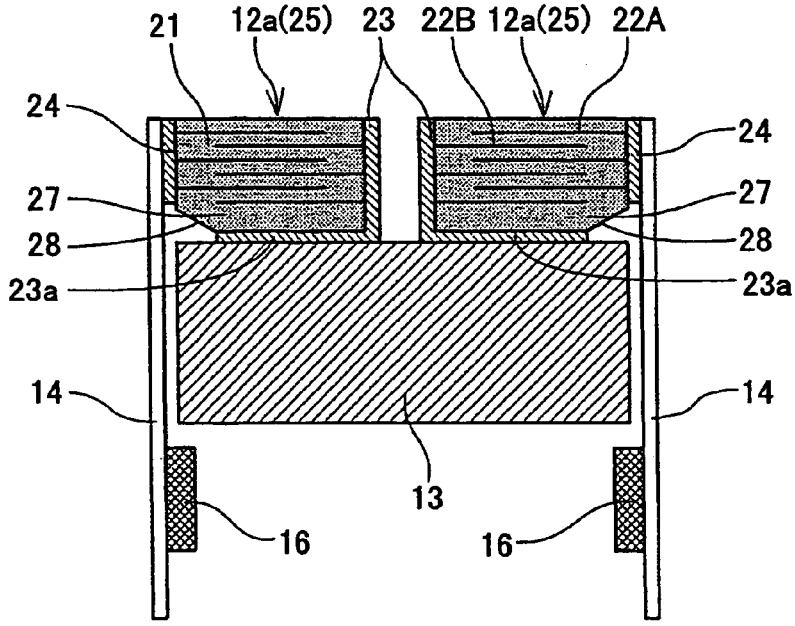
FIG. 12 is a cross-sectional view of the liquid discharge head taken along the line E-E indicated in FIG. 11.
Figure 13:
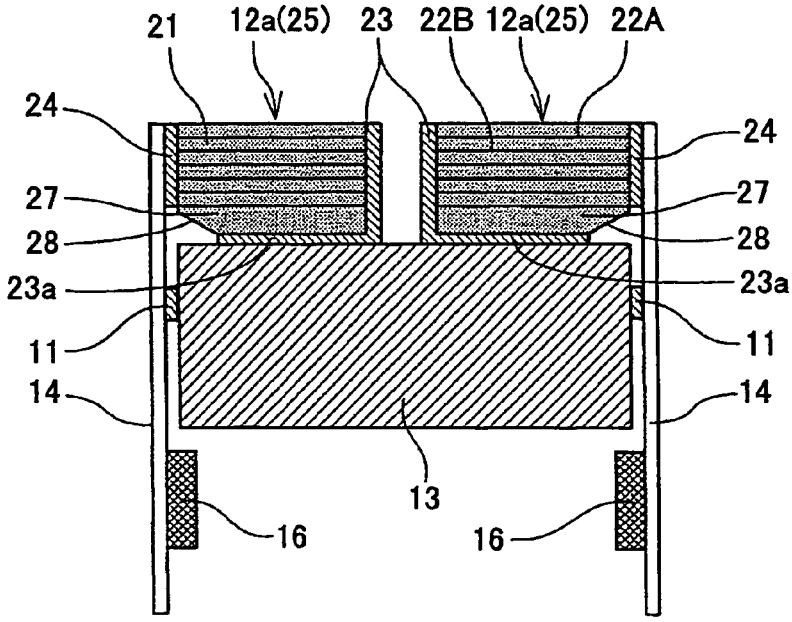
FIG. 13 is a cross-sectional view of the liquid discharge head taken along the line F-F indicated in FIG. 11.

Next, the composition of an ink jet head which is the liquid discharge head in the 5th embodiment of the invention will be explained with reference to FIG. 11 through FIG. 13. FIG. 11 is a perspective view of the principal portion of the liquid discharge head of this embodiment, FIG. 12 is a cross-sectional view of the liquid discharge head taken along the line E-E indicated in FIG. 11, and FIG. 13 is a cross-sectional view of the liquid discharge head taken along the line F-F indicated in FIG. 11.

In the present embodiment, the laminated type piezoelectric element members 12 which have the same composition as that in the 2nd embodiment are arranged in two rows of six pieces in parallel with the longitudinal direction thereof. The length of the liquid discharge head in the longitudinal direction thereof is about 330 mm.

The shorter-side width of the paper of A3 size can be covered because of the use of the 330 mm long liquid discharge head, and a line head that is capable of printing an image on the paper of A3 size can be obtained.

When the two laminated type piezoelectric element members 12 are arranged side by side along the longitudinal direction as in the previous embodiment of FIG. 1, the common electrodes can be taken from the outside end portions of the laminated type piezoelectric element members in the longitudinal direction. However, when three or more laminated type piezoelectric element members 12 are arranged along the longitudinal direction as in this embodiment, the common electrodes cannot be taken from the internal piezoelectric element member other than the piezoelectric element members located at the both ends of the head.

To obviate the problem, the base member 13 is electrically connected with the common electrodes in this embodiment. That is, as shown in FIG. 12, the internal electrodes 22B are electrically connected to the common external electrodes 23, and the common external electrodes 23 are provided integrally with the extension portions 23*a* extending to the back surface of the laminated type piezoelectric element member 12. And the extension portions 23*a* of the common external electrodes 23 on the back surface of the laminated type piezoelectric element member 12 are electrically connected to the conductive base member 13 which is made of a metallic material, such as SUS.

In this case, the extension portions 23*a* of the common external electrodes 23 on the back surface of the laminated type piezoelectric element member 12 and the base member 13 are bonded together by using a conductive adhesive agent, so that the mechanical bonding and the electric connection thereof can be attained simultaneously. It is possible to reduce the number of the manufacturing processes needed and attain the manufacture of the liquid discharge head with low cost.

And, as shown in FIG. 13, the base member 13 is connected at the end of the head with the FPC 14 by the solder 11, etc. Therefore, the internal electrodes 22B of the laminated type piezoelectric element member 12 are electrically connected to the FPC 14 via the base member 13.

When arranging the three or more laminated type piezoelectric element members along the longitudinal direction thereof, the common electrodes can be taken by electrically connecting each of the laminated type piezoelectric element members to the base member 13 respectively. Since the common electrodes are taken by using the base member 13, there is almost no influence of the voltage drop in the intermediate part of the liquid discharge head which is constructed in an elongated configuration.

Figure 14:
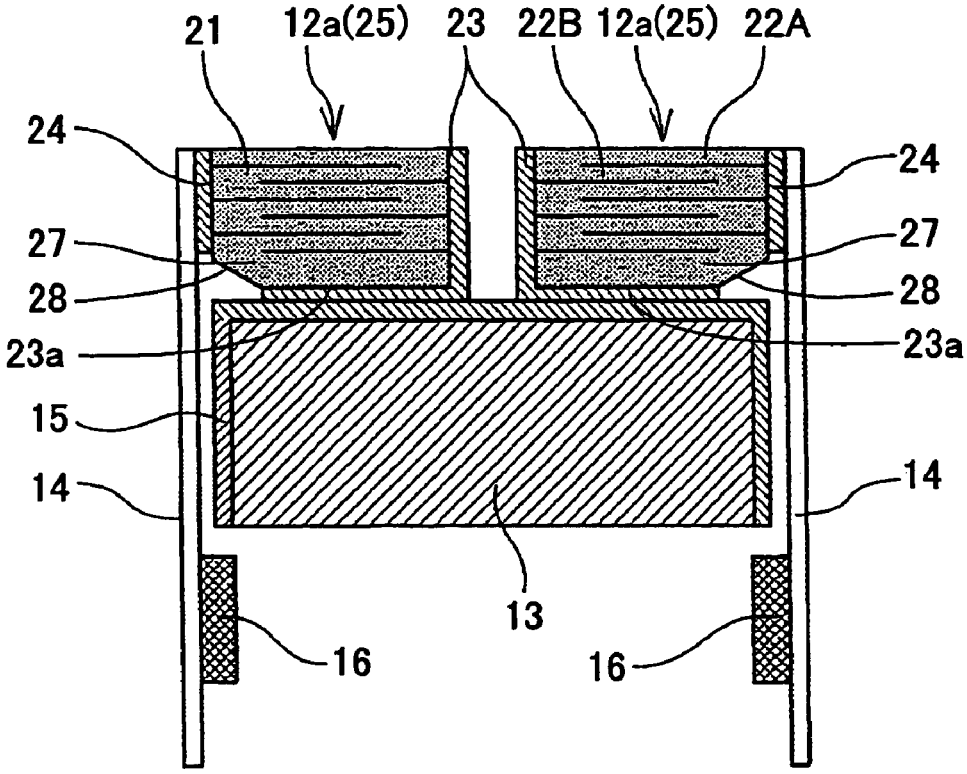
FIG. 14 is a cross-sectional view of the liquid discharge head in the 6th embodiment of the invention similar to that of FIG. 12.
Figure 15:
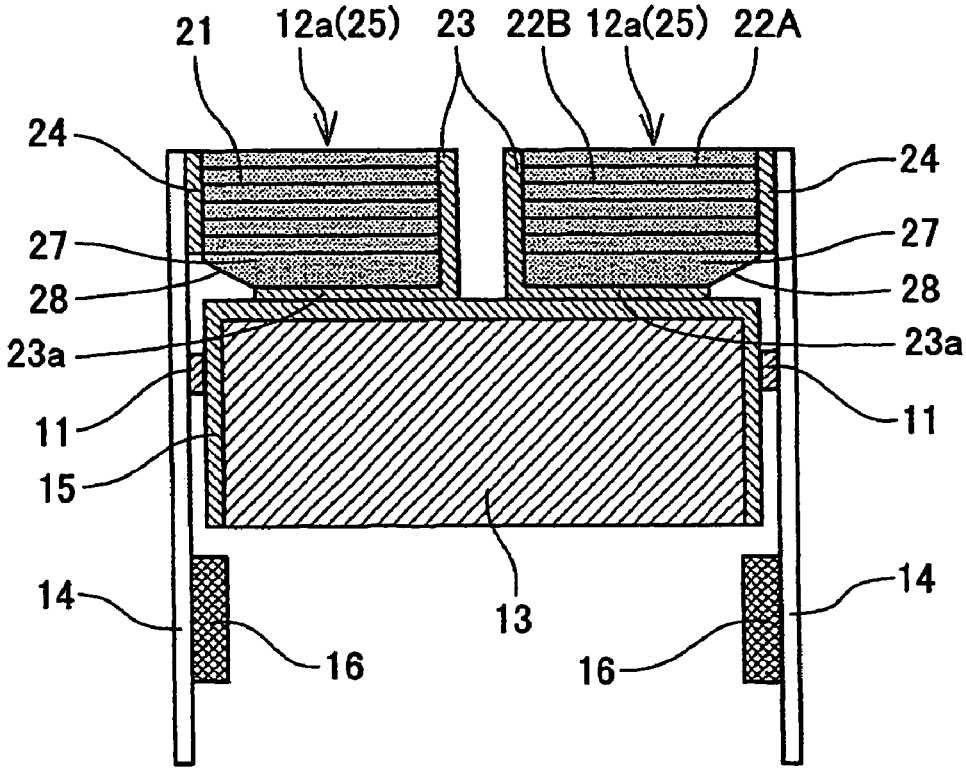
FIG. 15 is a cross-sectional view of the liquid discharge head in the 6th embodiment of the invention similar to that of FIG. 13.

Next, the composition of an ink jet head which is the liquid discharge head in the 6th embodiment of the invention will be explained with reference to FIG. 14 and FIG. 15. FIG. 14 is a cross-sectional view of the liquid discharge head in the 6th embodiment of the invention similar to that of FIG. 12. FIG. 15 is a cross-sectional view of the liquid discharge head in the 6th embodiment of the invention similar to that of FIG. 13.

In the present embodiment, the liquid discharge head has the composition which is essentially the same as that in the 5th embodiment, and the base member 13 is made of an insulating material, such as ceramics, and the thin-film electrodes 15 are formed on the surface of the base member 13.

The base member becomes long and slender if the liquid discharge head is produced in an elongated configuration, and it is necessary that the base member be made of a rigid material. In this embodiment, there is no restriction that the material of the base member is conductive, and it is possible to use the ceramics as the rigid material of the base member instead of the metallic material.

Figure 16:
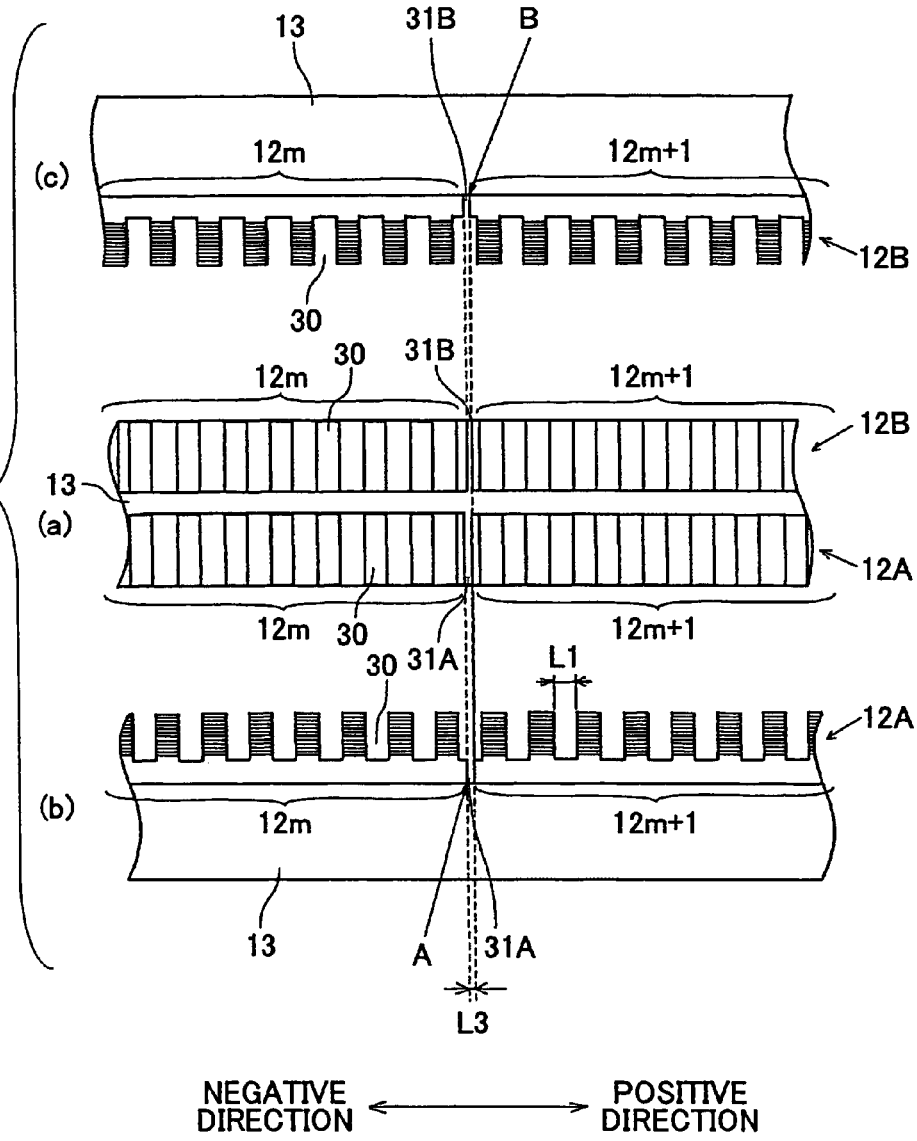
FIG. 16 is a diagram showing the composition of the liquid discharge head in the 7th embodiment of the invention.

Next, the composition of an ink jet head which is the liquid discharge head in the 7th embodiment of the invention will be explained with reference to FIG. 16. FIG. 16 shows the composition of the liquid discharge head in the 7th embodiment of the invention. In FIG. 16, (*a*) is a plan view of the principal portion of the liquid discharge head of this embodiment, (*b*) is a bottom view of the liquid discharge head of FIGS. 16 (*a*), and (*c*) is a top view of the liquid discharge head of FIG. 16 (*a*).

In the present embodiment, the plurality of piezoelectric element members 12 are arranged on the single base member 13 in rows, which is similar to the 1st embodiment of FIG. 1 mentioned above. Specifically, in the embodiment of FIG. 16, the piezoelectric element members 12 are arranged in two rows which are referred to as piezoelectric element row 12A and piezoelectric element row 12B respectively.

In the present embodiment, a gap 31A is formed in the boundary portion between the m-th piezoelectric element column 12*m* (m is an integer greater than one) and the (m+1)-th piezoelectric element column 12*m*+1 of the piezoelectric element row 12A. Similarly, a gap 31B is formed in the boundary portion between the m-th piezoelectric element column 12*m* and the (m+1)-th piezoelectric element column 12*m*+1 of the piezoelectric element row 12B.

In this case, each of the gaps 31A and 31B between the m-th piezoelectric element column 12*m* and the (m+1)-th piezoelectric element column 12*m*+1 has a width L3 which is smaller than the width L1 of one of the grooves formed by the slot processing (L3<L1). In other words, suppose that the edge position of the m-th piezoelectric element column 12*m* in the positive direction (the right-hand direction in FIG. 16) is referred to as the position A, and the edge position of the piezoelectric element column 12*m*+1 in the negative direction (the left-hand direction in FIG. 16) is referred to as the position B, the distance (B-A) between the position A and the position B is smaller than the width L1 of the groove 30 formed by the slot processing.

In the present embodiment, the liquid discharge head is arranged so that the width of the gap 31 between the m-th piezoelectric element column 12*m* and the (m+1)-th piezoelectric element column 12*m*+1 of each row is smaller than the width L1 of the groove 30 formed by the slot processing. Even if the gap 31 in the boundary portion between the m-th piezoelectric element column and the (m+1)-th piezoelectric element column differs in position for the columns of the piezoelectric element members, it is possible to absorb the gap 31 for each column within in the width of the groove 30 formed by the slot processing.

Figure 17:
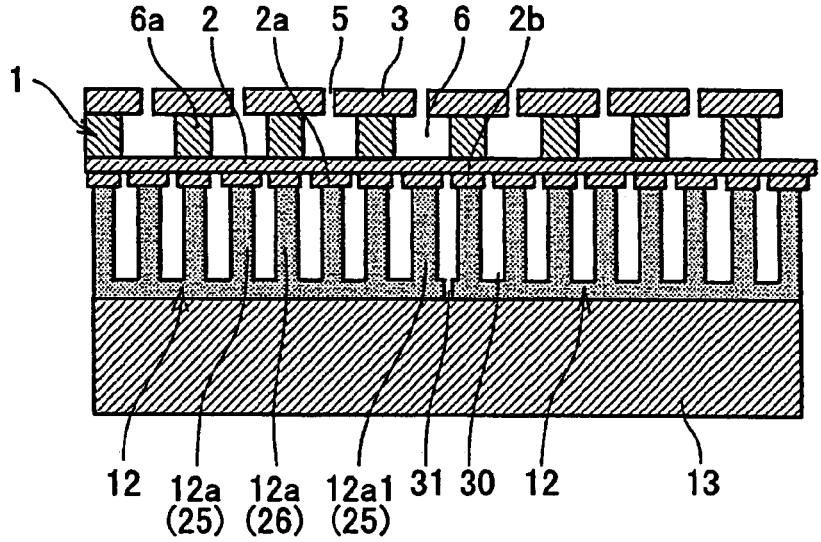
FIG. 17 is a cross-sectional view of the liquid discharge head in the 8th embodiment of the invention.

Next, the composition of an ink jet head which is the liquid discharge head in the 8th embodiment of the invention will be explained with reference to FIG. 17. FIG. 17 is a cross-sectional view of the liquid discharge head in the 8th embodiment of the invention taken along the direction of the nozzles of the liquid discharge head.

In the present embodiment, the piezoelectric elements 12*a* are arranged in a bi-pitch structure in which the actuation parts 25 to which the drive waveform is supplied, and the non-actuation parts 26 to which the drive waveform is not supplied are arranged alternately.

In the diaphragm plate 2, the plurality of convex parts 2*a* are formed in the portions which are bonded by the adhesive agent to the piezoelectric elements 12*a* used as the actuation parts 25, and the plurality of convex parts 2*b* are formed in the portions which are bonded by the adhesive agent to the piezoelectric elements 12*a* used as the non-actuation parts 26, respectively.

In the present embodiment, the convex parts are formed in the portions of the diaphragm bonded to the piezoelectric elements, and, even if a variation of the width (the width in the direction of the nozzle row) of the piezoelectric elements 12*a* arises, a variation in the drop discharge volume between the respective nozzles 5 can be reduced.

Figure 18:
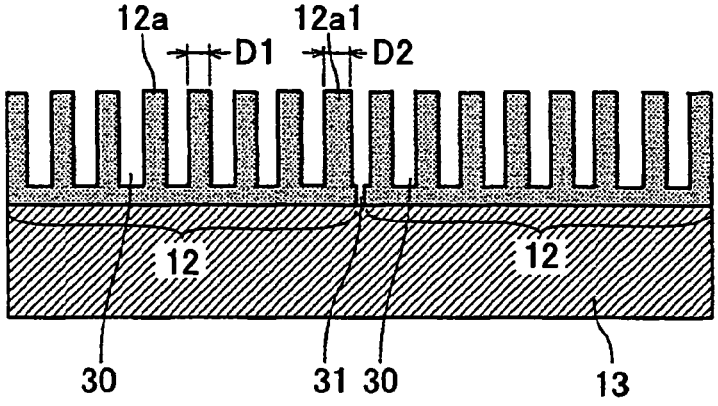
FIG. 18 is a diagram for explaining the piezoelectric element of the liquid discharge head of this embodiment.

As shown in FIG. 18, when the two piezoelectric element members 12 are bonded together on the base member 13 and the slot processing is performed, it is possible that the width D2 of the edge-position piezoelectric element 12*a*1 at the end of the piezoelectric element member 12 (adjacent to other piezoelectric element members 12) is larger than the width D1 of the other piezoelectric elements 12*a* (D2>D1).

Figure 19:
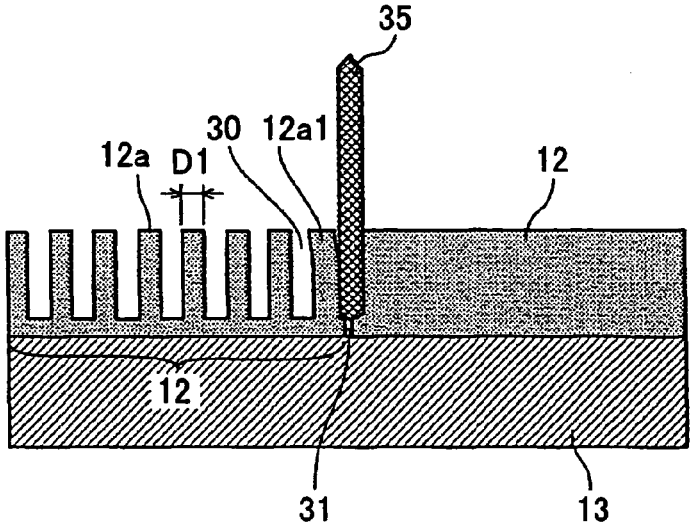
FIG. 19 is a diagram for explaining the process in which piezoelectric elements with different widths are produced.

This problem arises for the following reason. As shown in FIG. 19, when forming the groove 31 between two adjacent piezoelectric element members 12 by dicing, the edge-position piezoelectric element 12*a*1 of the piezoelectric element member 12 in which the slot processing is already performed receives the stress by the dicing blade 35 and is deformed to the side of the groove 30 which is already formed by the dicing blade 35. Therefore, the width D2 of the edge-position piezoelectric element 12*a*1 is larger than the width D1 of the other piezoelectric elements 12*a*.

To avoid the problem, according to this embodiment, the convex parts 2*a* are provided in the diaphragm 2, and the width of the convex parts 2*a* is formed so that it is the same as the width of each pressurized liquid chamber 6. In addition, the convex parts 2*b* are also provided in the position which is located under the partition 6*a* of the pressurized liquid chamber 6, and the height is made to be unified by the actuation parts 25 and the support part 26.

When there is no convex part 2*a* in the diaphragm 2, the width D1 of the piezoelectric element 12*a* differs from the width D2 of the piezoelectric element 12*a*1 and the width (area) of deformation of the diaphragm 2 is varied according to the piezoelectric element width, which causes a difference in the volume of a liquid drop which is discharged from the nozzle concerned.

To avoid the problem, the convex parts 2*a* are formed on the back surface of the diaphragm 2, and the piezoelectric elements 12*a* and the piezoelectric element 12*a*1 are bonded together. Even if the width of the edge-position piezoelectric element 12*a*1 is different from the width of the other piezoelectric elements 12*a*, the area which effectively acts on the diaphragm 2 depends on the width of the convex parts 2*a*. The pressure applied to the respective pressurized liquid chambers 6 is the same, and it is possible to reduce the variation in the volume of a liquid drop discharged from each nozzle 5.

According to the present embodiment, it is possible to prevent the deterioration of the picture quality of an image which is formed by the liquid discharge head.

The convex parts 2*a* and 2*b* of the diaphragm 2 may be integrally formed from the same material by, for example, electrocasting of nickel. Alternatively, the diaphragm 2 may be formed from a resin film, and the convex part 2*a* and 2*b* may be formed from a metallic material, such as stainless steel (SUS), through etching or patterning. Furthermore, the convex parts 2*a* and 2*b* may be formed in multiple layers, and in the case of the multiple layers, it is possible to make the widths (areas) of the convex parts 2*a* and 2*b* different between the multiple layers.

In each of the above-mentioned embodiments, the description thereof has been given by using the single ink jet head. However, the liquid discharge head of the invention may be configured into a head-integral type ink cartridge as shown in FIG. 20.

Figure 20:
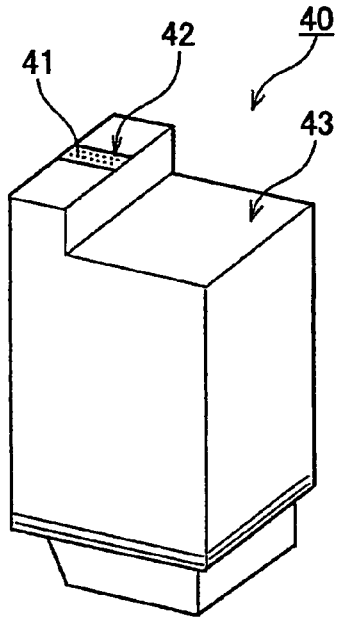
FIG. 20 is a perspective view of an example of the head-integral type ink cartridge in which the liquid discharge head of the invention is embodied.

As shown in FIG. 20, the head-integral type ink cartridge 40 comprises an ink jet head 41 having a plurality of nozzles 42, which is the liquid discharge head of the invention, and an ink tank 43 which contains the ink being supplied to the ink jet head 41. The ink jet head 41 and the ink tank 43 are united into the head-integral type ink cartridge 40. According to this embodiment, it is possible to obtain the head-integral type ink cartridge in which the multiple nozzles are arranged with high density. And the manufacture of a small-size liquid cartridge with low cost can be attained with good reliability.

Next, the composition of an ink-jet recording device which is the image forming device in which the liquid discharge device of the invention is embodied will be explained with reference to FIG. 21 and FIG. 22.

Figure 21:
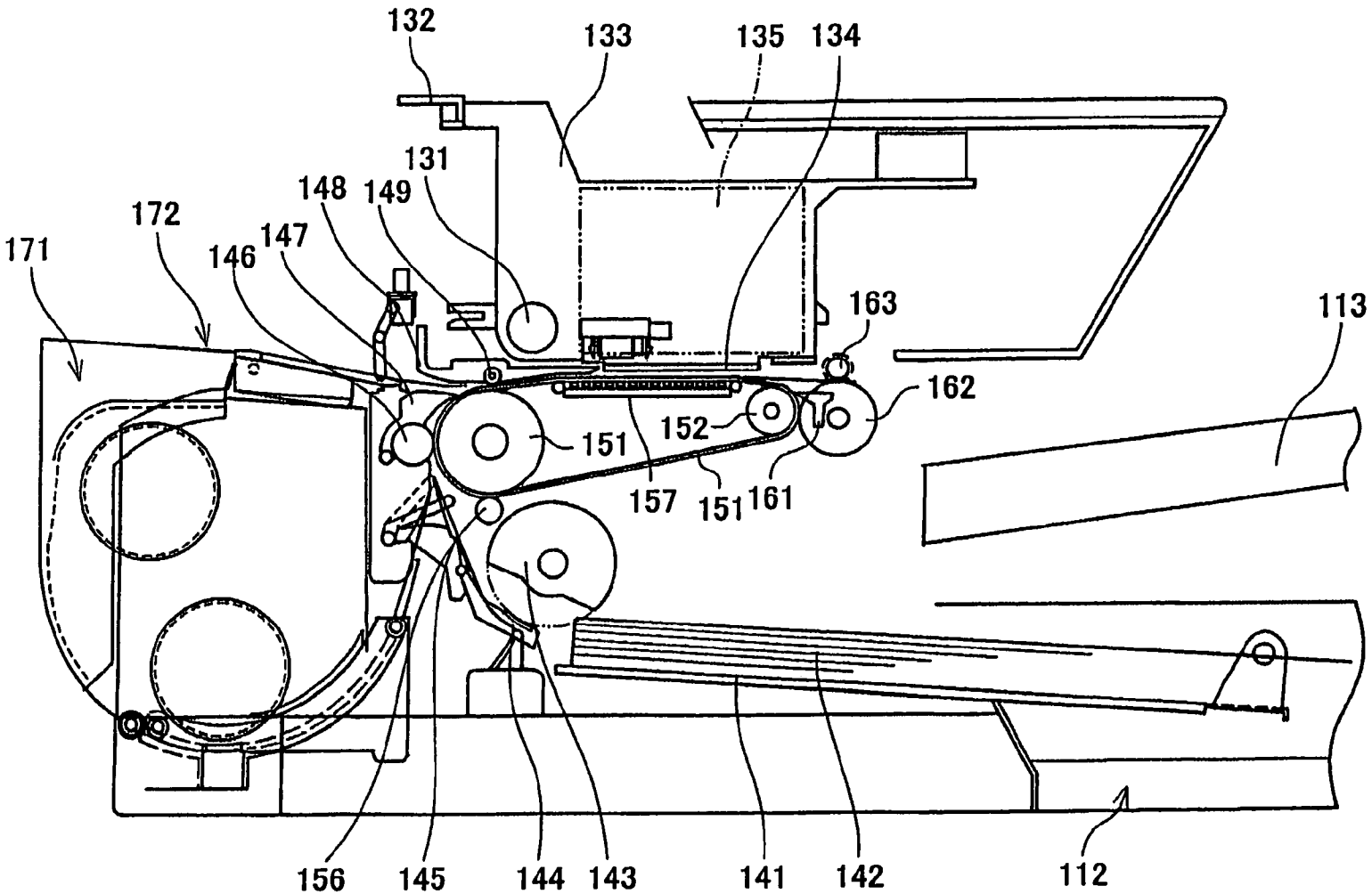
FIG. 21 is a diagram showing an example of the image forming device in which the liquid discharge device of the invention is embodied.
Figure 22:
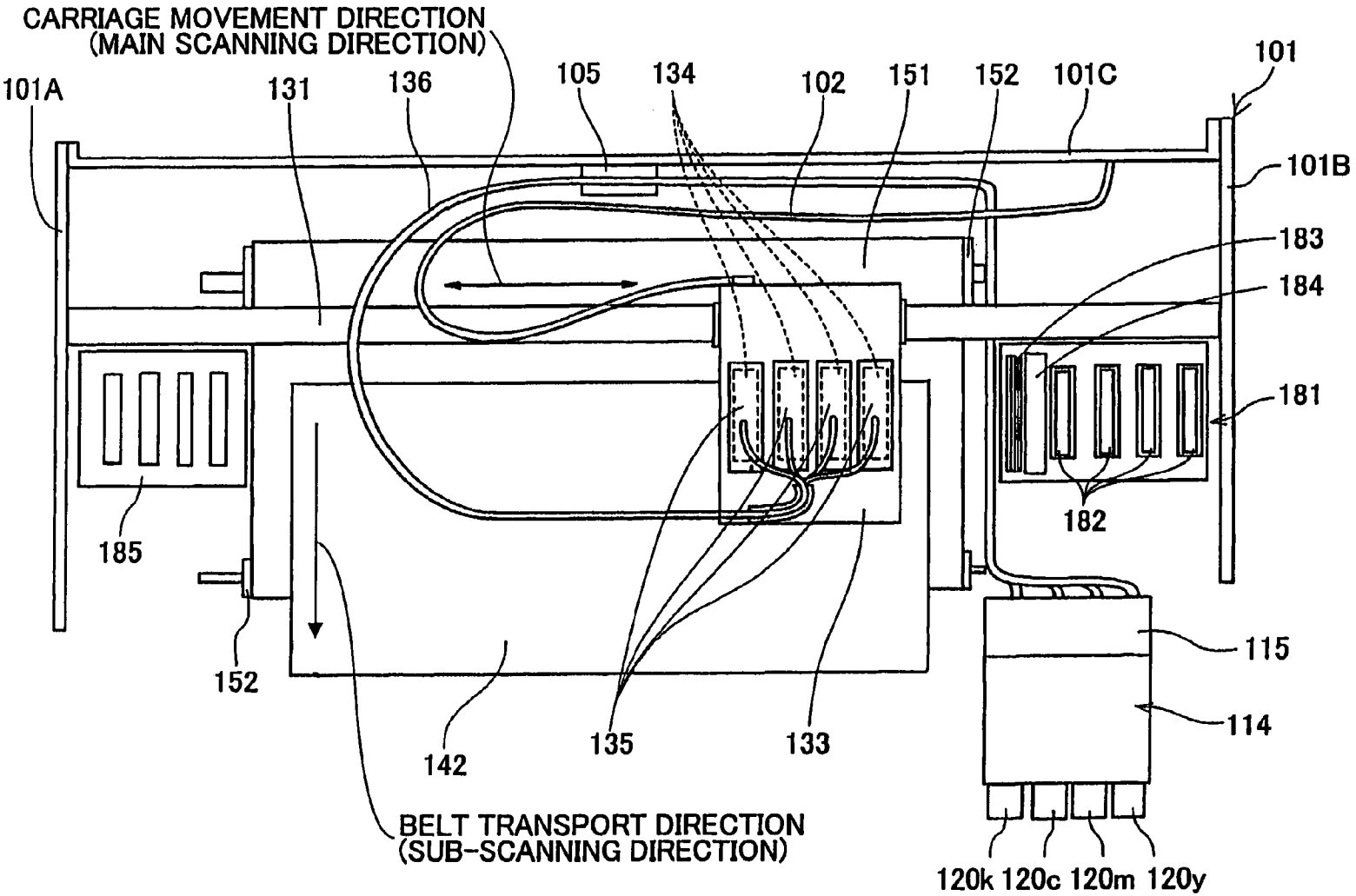
FIG. 22 is a plan view of the principal part of the image forming device of FIG. 21.

FIG. 21 is a diagram showing an example of the mechanism part of the image forming device in which the liquid discharge device of the invention is embodied, and FIG. 22 is a plan view of the principal portion of the mechanism part of FIG. 21.

In the image forming device, the carriage 133 is held, movably in the main scanning direction, by the stay 132 and the guide rod 131 which is the guide member horizontally disposed across the side covers 101A and 101B which constitute the frame 101. The carriage 133 is moved in the main scanning direction (carriage movement direction), indicated by the arrow in FIG. 22, by the scanning motor which is not illustrated.

In the above-mentioned carriage 133, the recording heads 134 including the four ink jet heads of yellow (Y), cyan (C), magenta (M), and black (Bk) which are the liquid discharge heads of the invention which discharge the ink drop of each color are provided. The recording heads 134 are arranged so that the ink discharge openings are arrayed in the direction which is perpendicular to the main scanning direction, and the ink drop discharge direction is directed downward.

As mentioned above, the driver ICs are carried on the recording heads 134 and connected to the control part which is not illustrated through the harness (flexible printed cable) 102.

The sub-tanks 135 for supplying the inks of the respective colors to the recording heads 134 are also carried on the carriage 133. Supplement supply of the ink of each color to the subtank 135 of each color is carried out through the ink supply tube 136 of each color from the ink cartridge 120 (120*k*, 120*c*, 120*m*, 120*y*) which is inserted into the cartridge loading part 114. The supply pump unit 115 for supplying the ink in the ink cartridge 120 is disposed in the cartridge loading part 114, and the intermediate part of the ink supply tube 136 is held by the locking member 105 disposed on the back plate 101C which constitutes the frame 101.

On the other hand, as a paper feeding part for feeding the paper 142 stacked on the paper stacking part (pressure plate) 141 of the paper feed tray 112, the separating pad 144 which is made of a material with a large coefficient of friction is disposed to confront the hemi-circular feed roller 143 which carries out the separation feeding of every sheet of the paper 142 from the paper stacking part 141. The separating pad 144 is pushed against the surface of the feed roller 143.

In order to transport the paper 142 fed from the paper feeding part, to the lower part of the recording heads 134, the guide member 145 which guides the paper 142, the counter roller 146, the conveyance guide member 147, and the retainer member 148 which has the edge pressurization roller 149 are provided. Moreover, the transport belt 151 is provided, and this transport belt 151 is a transport unit for electrostatically attracting the paper 142 and for conveying the paper 142 to the position which confronts the recording heads 134.

The transport belt 151 is an endless form belt, and this transport belt 151 is wound between the conveyance roller 152 and the tension roller 153 such that it is rotated in the belt transport direction (the sub-scanning direction).

The transport belt 151 has a front layer and a back layer. The front layer is used as a paper attraction surface and formed from a resin material which is about 40 micrometers thick and is not subjected to resistance control. For example, the front layer is formed from an ETFE material. The back layer (middle resistance layer, ground layer) is formed from the same material as the front layer and subjected to resistance control by carbon.

Moreover, the charging roller 156 is provided, and this charging roller 156 is a charging unit for electro-statically charging the surface of the transport belt 151. The charging roller 156 contacts the front layer of the transport belt 151 and is arranged so that it is rotated to follow the rotation of the transport belt 151. A predetermined pressure is exerted on the both ends of the shaft of the charging roller 156 as a pressing pressure.

The conveyance roller 152 serves also as a grounding roller and is in contact with the middle resistance layer of the transport belt 151, so that the transport belt is grounded.

On the back surface of the transport belt 151, the guide member 157 is arranged corresponding to the printing area by the recording head 134. The guide member 157 has the front surface which projects toward the recording head 134 side beyond the tangent line of the two rollers supporting the transport belt 151 (conveyance roller 152 and tension roller 153) in order to maintain the flatness of the transport belt 151 with the front surface.

The transport belt 151 is rotated in the belt transport direction when the conveyance roller 152 is rotated through the driving belt by the feed motor which is not illustrated.

Moreover, as a sheet ejection unit for ejecting the paper 142 in which the image is recorded by the recording head 134, the separation nail 161 for separating the paper 142 from the transport belt 151, the delivery roller 162 and the delivery roller 163 are provided. And the paper output tray 113 is disposed under the delivery roller 162. In the present embodiment, the position between the delivery roller 162 and the delivery roller 163 is raised from the paper output tray 113 to a certain height in order to increase the amount of the paper which can be stacked on the paper output tray 113.

On the back surface of the main part 1 of the image forming device, the duplex unit 171 is detachably mounted. The duplex unit 171 receives the paper 142 which is returned by the opposite-direction rotation of the transport belt 151, and reverses the paper 142, and feeds again the reversed paper 142 to the position between the counter roller 146 and the transport belt 151. The upper surface of the duplex unit 171 serves as the manual feed tray 172.

Moreover, as shown in FIG. 22, in the non-printing area on one side of the carriage 133 in the main scanning direction, the maintenance recovery mechanism (subsystem) 181 for maintaining and recovering the state of the nozzles of recording heads 134 is arranged. In this maintenance recovery mechanism 181, the cap member 182 for capping each nozzle face of the recording heads 134, the wiper blade 183 for wiping the nozzle faces, and the dummy discharge receptacle 184 for receiving the drops discharged when performing the dummy discharge (the discharging of the drops which do not contribute to the image recording) are provided.

Similarly, in the non-printing area on the other side of the carriage 133 in the main scanning direction, the dummy discharge receptacle 185 for receiving the drops discharged at the time of the dummy discharge is also provided.

In the above-described image forming device, the separation feeding of every sheet of the paper 142 is carried out from the paper feed tray 112, and the paper 142 fed to the upper part is guided by the guide member 145. The paper 142 is pinched between the transport belt 151 and the counter roller 146 and transported. The paper edge is further guided by the conveyance guide 147 and pushed against the transport belt 151 by the edge pressurization roller 149, and the direction of the transport is changed by about 90 degrees.

At this time, the control circuit (which is not illustrated) controls the alternating application of the plus voltage and the minus voltage from the high voltage power supply to the charging roller 156, and the transport belt 151 is subjected to the alternately charging voltage pattern. In the transport belt 151, the belt-like regions of a predetermined width are alternately charged by the plus and minus voltages and arrayed in the sub-scanning direction which is the circumference direction of the transport belt 151.

When the paper 142 is fed on the transport belt 151 charged alternately with the plus and minus voltages, the paper 142 is attracted by the transport belt 151 and conveyed in the sub-scanning direction by the rotary movement of the transport belt 151.

Then, while the carriage 133 is moved in the main scanning direction, the recording head 134 is driven in accordance with the image signal, so that the ink drops are discharged to the stopped paper 142 and an image is recorded on the paper 142 by one scanning line. After the paper 142 is transported by a given distance in the sub-scanning direction, the image is recorded on the paper 142 by the following scanning line. When the print end signal or the signal indicating the arrival of the paper rear edge at the printing region is received, the recording operation of the recording head 134 is terminated and the paper 142 is delivered to the paper output tray 113.

The recording head in this image forming device is constituted by the liquid discharge head of the invention, and the liquid discharge head of the invention can attain high-density ink discharging by using the elongated configuration. Thus, it is possible to attain a high-quality ink-jet recording device with a small size and high printing speed.

In the above-mentioned embodiments, the liquid discharge head of the invention is applied to the ink jet head but the present invention is not limited to the ink jet head. Alternatively, the present invention may be applied to a liquid discharge head which discharges drops of a liquid other than the ink, such as a liquid resist for patterning, and a liquid discharge head which discharges drops of a gene analysis sample, etc.

Figure 23:
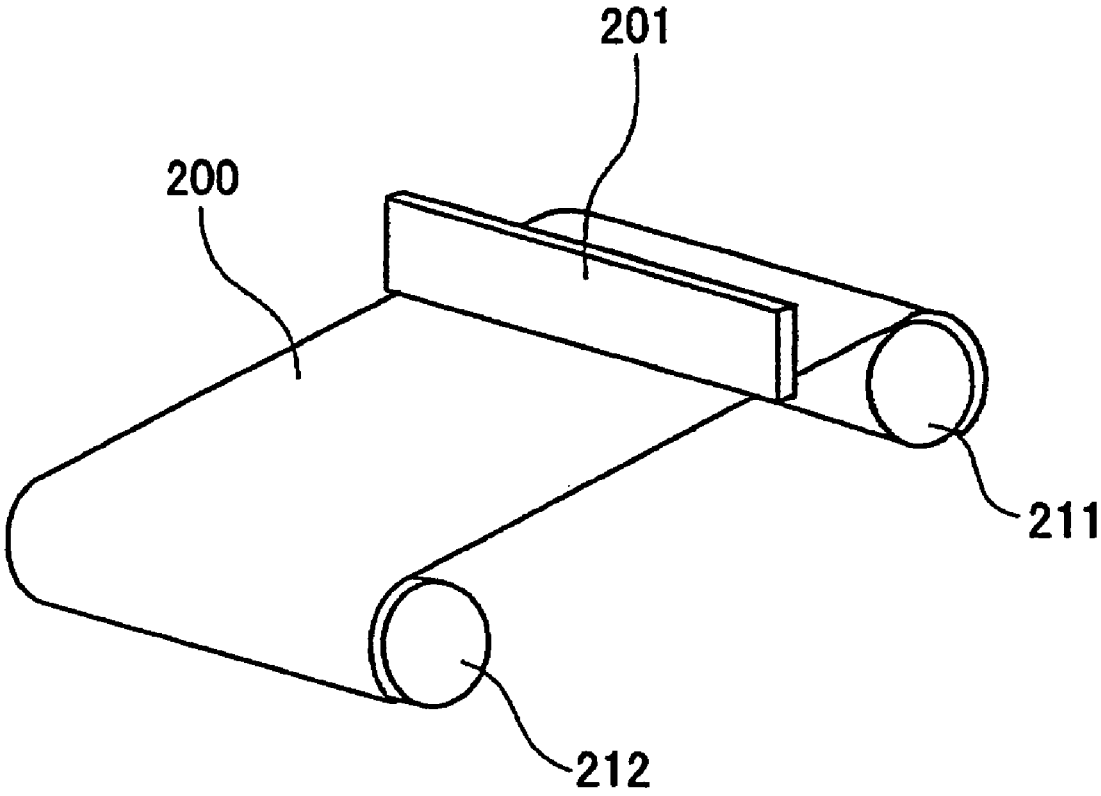
FIG. 23 is a perspective view of another example of the image forming device in which the liquid discharge device of the invention is embodied.

Next, another example of the image forming device in which the liquid discharge device of the invention is embodied will be explained with reference to FIG. 23. FIG. 23 is a perspective view of the image forming device of this example.

In the image forming device of FIG. 23, the full-line head 201 is provided. In the full-line head 201, the recording medium (paper) 200 is transported by the conveyance roller 211 and the feeding roller 212. A plurality of discharge nozzles are disposed on the head 201 to cover the whole width of the recordable area of the recording medium 200.

The full line head 201 is arranged to cross the transport path of the recording medium 200 transported by the conveyance roller 211, and an image can be recorded in the full recordable area of the recording medium 200 at a time.

In a case of the full-line ink-jet recording device, when the recording medium is a thin sheet or thin plain paper, the problem in which the paper contacts the head due to swelling or wrinkling of the paper through osmosis of the ink easily arises. In this case, the use of a high viscosity ink may reduce the osmosis of the ink on the paper and may prevent the occurrence of the above problem.

Moreover, in the case of the full-line ink-jet recording device, it is necessary to complete the printing of the full main scanning line at a time. For this reason, the nozzles and the liquid channels must be arranged with high density in the recording head used for the full-line ink-jet recording device.

According to the liquid discharge head of the invention, the liquid channels can be arranged with high density and the high viscosity ink can be used without problem. The liquid discharge head of the invention is effective for use in the full-line recording head or full-line type device.

In the above-mentioned embodiments, the liquid discharge device of the invention has been applied to the image forming device which is constructed in the printer composition. However, the present invention is not limited to such embodiments. Alternatively, the present invention may be applied to the image forming device which is constructed in the composition of a multi-function peripheral having printer/fax/copier functions. Moreover, the present invention may also be applied to the image forming device using a recording liquid other than the ink, a fixing treating solution, etc.

The present invention is not limited to the above-described embodiments and variations and modifications may be made without departing from the scope of the invention.

Further, the present application is based upon and claims the benefit of priority from Japanese patent application No. 2004-344075, filed on Nov. 29, 2004, and Japanese patent application No. 2005-290417, filed on Oct. 3, 2005, the entire contents of which are incorporated herein by reference.

The invention claimed is:

1. A liquid discharge head comprising:

a base member;

a plurality of nozzles which discharge drops of a liquid;

a plurality of liquid chambers which communicate with the plurality of nozzles respectively; and a plurality of piezoelectric elements generating a pressure to pressurize the liquid in each of the plurality of liquid chambers, wherein a plurality of piezoelectric element members in which the plurality of piezoelectric elements are formed with grooves, which are formed in the piezoelectric member so as not to reach the base member, in columns by slot processing are arranged on the base member in rows along a direction of the columns of the plurality of piezoelectric elements.

2. The liquid discharge head of claim 1 wherein a groove at a boundary portion between two adjacent columns of the plurality of piezoelectric element members is further formed by the slot processing.

3. The liquid discharge head of claim 1 wherein a gap is formed in a boundary portion between two adjacent columns of the plurality of piezoelectric element members and the gap has a width smaller than a width of one of the grooves formed by the slot processing.

4. The liquid discharge head of claim 1 wherein common external electrodes arc electrically connected to the base member to supply a drive waveform to each of the plurality of piezoelectric elements.

5. The liquid discharge head of claim 4 wherein the plurality of piezoelectric elements and the base member are bonded together by using a conductive adhesive agent.

6. The liquid discharge head of claim 1 wherein a nozzle plate in which the plurality of nozzles are formed is provided for the plurality of piezoelectric element members.

7. The liquid discharge head of claim 1 wherein the plurality of piezoelectric element members arc arranged in columns On the base member, a gap is formed in a boundary portion between an m-th piezoelectric element column (where in is an integer greater than one) and an (m+1)-th piezoelectric element column or the plurality of piezoelectric element members, and the gap has a width smaller than a width of one of the grooves by the slot processing.

8. The liquid discharge head of claim 1 wherein a plurality of convex parts are respectively disposed at a plurality or bonded portions between the plurality of piezoelectric elements and a diaphragm which forms a surface of walls of the plurality of liquid chambers.

9. A liquid discharge device including a liquid discharge head and a liquid container, the liquid discharge head comprising:

a base member;

a plurality of nozzles which discharge drops of a liquid;

a plurality of liquid chambers which communicate with the plurality of nozzles respectively; and a plurality of piezoelectric elements generating a pressure to pressurize the liquid in each of the plurality of liquid chambers, wherein a plurality of piezoelectric element members in which the plurality of piezoelectric elements are formed with grooves, which arc formed in the piezoelectric member so as not to reach the base member, in columns by slot processing arc arranged on the base member in rows along a direction of the columns of the plurality of piezoelectric elements.

10. The liquid discharge device of claim 9, wherein a gap is formed in a boundary portion between two adjacent columns of the plurality of piezoelectric element members and the gap has a width smaller than a width of one of the grooves formed by the slot processing.

11. The liquid discharge device of claim 9, wherein the plurality of piezoelectric element members are arranged in columns on the base member, a gap is formed in a boundary portion between an m-th piezoelectric element column (where m is an integer greater than one) and an (m+1)-th piezoelectric element column of the plurality of piezoelectric element members, and the gap has a width smaller than a width of one of the grooves by the slot processing.

12. An image fanning device which is provided with a liquid discharge head and Forms an image on a recording medium by discharging drops of a liquid from the liquid discharge head to the recording medium, the liquid discharge head comprising:

a base member;

a plurality of nozzles which discharge drops of a liquid;

a plurality of liquid chambers which communicate with the plurality of nozzles respectively; and a plurality of piezoelectric elements generating a pressure to pressure the liquid in each of the plurality of liquid chambers, wherein a plurality of piezoelectric element members in which the plurality of piezoelectric elements are formed with grooves, which are formed in the piezoelectric member so as not to reach the base member, in columns by slot processing are arranged on the base member in rows along a direction of the columns of the plurality of piezoelectric elements.

13. The image forming device of claim 12, wherein a gap is formed in a boundary portion between two adjacent columns of the plurality of piezoelectric element members and the gap has a width smaller than a width of one of the grooves formed by the slot processing.

14. The image forming device of claim 12, wherein the plurality of piezoelectric element members are arranged in columns on the base member, a gap is formed in a boundary portion between an m-th piezoelectric clement column (where in is an integer greater than one) and an (m+1)-th piezoelectric element column of the plurality of piezoelectric element members, and the gap has a width smaller than a width of one of the grooves by the slot processing.

* * * * *